US011835255B2

(12) United States Patent
Johnson et al.

(10) Patent No.: US 11,835,255 B2
(45) Date of Patent: Dec. 5, 2023

(54) COOLING PANEL SYSTEM

(71) Applicant: SkyCool Systems, Inc., Mountain View, CA (US)

(72) Inventors: David Urnes Johnson, Sunnyvale, CA (US); Aaswath Raman, Los Angeles, CA (US); Eli A. Goldstein, Mountain View, CA (US)

(73) Assignee: SkyCool Systems, Inc., Mountain View, CA (US)

( * ) Notice: Subject to any disclaimer, the term of this patent is extended or adjusted under 35 U.S.C. 154(b) by 0 days.

(21) Appl. No.: 16/729,173

(22) Filed: Dec. 27, 2019

(65) Prior Publication Data

US 2020/0208854 A1 Jul. 2, 2020

Related U.S. Application Data

(60) Provisional application No. 62/785,591, filed on Dec. 27, 2018.

(51) Int. Cl.

| | |
|---|---|
| ***F24F 5/00*** | (2006.01) |
| ***F28F 3/12*** | (2006.01) |
| ***F24F 11/84*** | (2018.01) |

(52) U.S. Cl.

CPC ..... *F24F 5/0089* (2013.01); *F24F 5/0046* (2013.01); *F24F 11/84* (2018.01); *F28F 3/12* (2013.01)

(58) Field of Classification Search

CPC ..... F24F 5/0089; F24F 11/84; F24F 5/0046; F24F 2005/0064; F28F 2245/06; F28F 13/18

See application file for complete search history.

(56) References Cited

U.S. PATENT DOCUMENTS 3,154,139 A 10/1964 Hager, Jr.
3,310,102 A 3/1967 Felix
(Continued)

FOREIGN PATENT DOCUMENTS

CN 103287014 A 9/2013
CN 107 883 493 4/2018
(Continued)

OTHER PUBLICATIONS

Zhao, Dongliang et al., "Radiative sky cooling-assisted thermoelectric cooling system for building applications," Energy, Elsevier, vol. 190, Jan. 1, 2020, 116322.
(Continued)

*Primary Examiner* — Lionel Nouketcha
(74) *Attorney, Agent, or Firm* — HALEY GUILIANO LLP

(57) ABSTRACT

A cooling system includes one or more cooling panels for affecting a cooling load in an environment. The cooling system also includes a heat exchanger coupled to the one or more cooling panels. Each cooling panel includes a film, a panel body, an inlet port, an outlet port, and a fluid path. The film's radiative properties allow it to achieve a temperature less than an environment temperature. The heat exchanger includes ports that are coupled to the fluid paths of the one or more cooling panels. A control system is used to control flow rates, flow paths, fluid temperatures, component temperatures, cooling rates, component operation, or other aspects of a cooling system. For example, the control system controls or monitors pumps, compressors, fans, valves, sensors, actuators, or a combination thereof.

32 Claims, 20 Drawing Sheets

(56) References Cited

U.S. PATENT DOCUMENTS 4,064,867 A 12/1977 Schlesinger
4,147,040 A 4/1979 Altman
4,323,619 A 4/1982 Silvestrini et al.
4,337,990 A 7/1982 Fan
4,423,605 A 1/1984 Petrick et al.
4,571,952 A * 2/1986 Greenfield ..... F25B 13/00 62/235.1
4,586,350 A 5/1986 Berdahl
4,624,113 A 11/1986 Hull
5,339,198 A 8/1994 Wheatly
5,405,680 A 4/1995 Chang
5,811,180 A 9/1998 Berdahl
5,830,713 A 11/1998 Ferrari et al.
6,262,830 B1 7/2001 Scalora
6,830,713 B2 12/2004 Hebrink et al.
7,105,117 B2 9/2006 Rodgers et al.
7,274,458 B2 9/2007 Perez et al.
7,325,542 B2 * 2/2008 Mejia ..... F24S 30/455 126/605
7,503,971 B2 3/2009 Wojtysiak
7,901,870 B1 3/2011 Wach
8,012,571 B2 9/2011 Liu et al.
8,182,924 B2 5/2012 Hebrink et al.
8,263,731 B2 9/2012 Liu et al.
8,409,720 B2 4/2013 Hebrink et al.
8,630,040 B2 1/2014 Bright et al.
8,766,385 B2 7/2014 Gidon
8,792,165 B2 7/2014 Merrill et al.
8,846,169 B2 9/2014 McCormick et al.
8,854,730 B2 10/2014 Wang et al.
8,861,072 B2 10/2014 Arsenault et al.
8,879,151 B2 11/2014 Merrill et al.
8,975,011 B2 3/2015 Dunn et al.
8,975,012 B2 3/2015 Dunn et al.
8,982,462 B2 3/2015 Merrill et al.
9,012,044 B2 4/2015 Bright
9,019,607 B2 4/2015 Merrill et al.
9,034,459 B2 5/2015 Condo et al.
9,097,858 B2 8/2015 Merrill
9,291,757 B2 3/2016 Merrill et al.
9,574,783 B2 2/2017 Hollick
9,709,349 B2 7/2017 Raman
9,927,188 B2 3/2018 Liu et al.
10,060,686 B2 8/2018 Liu et al.
10,131,838 B2 11/2018 Berdahl
10,173,792 B1 1/2019 Burckel
10,273,024 B1 4/2019 Youngquist et al.
10,323,151 B2 6/2019 Van Overmeere et al.
10,371,416 B2 8/2019 Jin et al.
10,386,097 B2 8/2019 Yu et al.
10,502,505 B2 12/2019 Yang et al.
10,514,215 B2 12/2019 Han et al.
10,584,250 B2 3/2020 Van Overmeere et al.
10,591,190 B2 3/2020 Yoshihiro et al.
10,698,312 B2 6/2020 Van Zwol et al.
10,724,809 B2 7/2020 Yang et al.
10,947,394 B2 3/2021 Xu et al.
11,067,316 B2 7/2021 Shenhav et al.
11,078,593 B2 8/2021 Chen et al.
11,084,943 B2 8/2021 Van Overmeere et al.
11,084,944 B2 8/2021 Van Overmeere et al.
2002/0063223 A1 5/2002 DeSteese
2003/0030041 A1 2/2003 Genjima
2004/0025931 A1 * 2/2004 Aguglia ..... F24S 10/17 136/246
2004/0041742 A1 3/2004 Fink
2004/0068046 A1 4/2004 Hugo
2005/0064094 A1 3/2005 Wojtysiak
2005/0133082 A1 * 6/2005 Konold ..... H02S 40/44 136/246
2005/0152417 A1 7/2005 Lin
2005/0163983 A1 7/2005 Watase
2005/0167612 A1 8/2005 Jaffer
2005/0247337 A1 11/2005 Chen
2005/0274374 A1 12/2005 Boguslayskiy
2006/0076868 A1 4/2006 Pullini
2006/0162762 A1 7/2006 Gilman
2007/0227170 A1 * 10/2007 Peng ..... G06F 1/20 62/259.2
2009/0009856 A1 1/2009 Hasman
2009/0127478 A1 5/2009 Inoue
2009/0128893 A1 5/2009 McCarthy
2010/0040796 A1 2/2010 Chueh
2010/0155043 A1 6/2010 Smith
2010/0294325 A1 11/2010 Lee
2011/0151507 A1 6/2011 van Walsem
2012/0210736 A1 8/2012 Rockenfeller
2014/0131023 A1 5/2014 Raman et al.
2015/0131146 A1 5/2015 Fan et al.
2015/0132596 A1 5/2015 Yamada
2015/0338175 A1 11/2015 Raman et al.
2016/0362807 A1 12/2016 Casse
2016/0363394 A1 * 12/2016 Liu ..... F28F 13/18
2017/0248381 A1 8/2017 Yang
2017/0314878 A1 11/2017 Raman
2018/0023866 A1 1/2018 Chen et al.
2018/0180331 A1 6/2018 Yu
2018/0244928 A1 8/2018 Van Overmeere
2019/0152410 A1 5/2019 Zhu
2019/0239586 A1 8/2019 Cui
2019/0316854 A1 10/2019 Fain
2019/0391301 A1 12/2019 Takatori

FOREIGN PATENT DOCUMENTS

EP 3 106 814 12/2016
EP 3 106 815 12/2016
WO WO2010033082 3/2010
WO WO2017151514 9/2017
WO WO2018180177 10/2018

OTHER PUBLICATIONS

International Search Report and Written Opinion of PCT/US2019/068818 dated Apr. 14, 2020.
U.S. Appl. No. 16/852,132, filed Apr. 17, 2020, Aaswath Raman.
U.S. Appl. No. 17/146,172, filed Jan. 11, 2021, Aaswath Raman.
International Search Report and Written Opinion dated Jul. 23, 2020 for International Application No. PCT/US2020/028821, filed Apr. 17, 2020.
Eden Rephaeli et al "Ultrabroadband Photonic Structures to Achieve High-Performance Daytime Radiative Cooling" NANO Letters 13, ACS Publications, American Chemical Society, 1457-1461 (Mar. 5, 2013).
Angus R. Gentle and Geoff B.Smith "A Subambient Open Roof Surface under the Mid-Summer Sun." Advanced Science 2, Material Views, 1-4 (2015).
3M. "Vikuity™ Enhanced Specular Reflector (ESR)." Vikuity-m Display Enhancement Application Guidelines, 4 pgs. (2003).
3M. "Vikuity™ Enhanced Specular Reflector Film (ESR) Material Safety Data Sheet," (Feb. 1-5, 2006).
Marquier et al. Coherent spontaneous emission of light by thermal sources, Physical Review B6 69, 155412, 2004.
Arnold et al., Coherent thermal infrared emission by two-dimensional silicon carbide gratings, Physical Review B 86, 035316, Jul. 2012.
R. Farrington and J. Rugh, "Impact of vehicle air-conditioning on fuel economy, tailpipe emissions, and electric vehicle range," Tech. Rep., National Renewable Energy Laboratory, http://www.nrel.dov/docs/KOosti/28960.pdf (2000).
R. Robb, A. Brooker, L. Ramroth, J. Rugh and K. Smith, ""Analysis of off-board powered thermal preconditioning in electric drive vehicles,"" Tech. Rep., National Renewable Energy Laboratory, http://www.nrel.gov/vehiclesandfuels/vsa/pdfs/49252..df (2010).
A. Burdick, "Strategy guideline: Accurate heating and cooling load calculations," Tech. Rep., U.S. Dept. of Energy: Energy Efficiency and Renewable Energy, httd://www.nrel.dovidocsifyl 1ostif51603 pdf (Jun. 2011).
Peilin, Chen, "Q&A On Air-Conditioning Technology," Tongji University Press, pp. 225-226, May 2003.

(56) References Cited

OTHER PUBLICATIONS

Enze, Xie et al., "Comprehensive Knowledge Manual for Chemical Technicians," Jilin Science and Technology Press, pp. 65, Sep. 30, 1990. (English Translation).
Xie Enze, et al., Editor, "Comprehensive Knowledge Manual for Chemical Technicians", p. 65 with translation (total of 11 pages) (1900).

* cited by examiner

COOLING PANEL SYSTEM

CROSS REFERENCE TO RELATED APPLICATION

This application claims the benefit of U.S. Provisional Patent Application No. 62/785,591 filed Dec. 27, 2018, the disclosure of which is hereby incorporated by reference herein in its entirety.

BACKGROUND

A variety of systems require cooling, including, for example, air conditioning systems (e.g., residential and commercial), vehicles, industrial processes, compressors, data centers, and refrigeration systems (e.g., markets, breweries, trucking). Energy requirements for cooling pose a cost, and typically more efficient techniques for cooling provide for energy savings.

SUMMARY

In some embodiments, the present disclosure is directed to a cooling system. The cooling system includes a plurality of cooling panels for affecting a cooling load in an environment and a heat exchanger. Each cooling panel includes a film, ports, and a fluid path. The film has a first set of radiative properties that allow the film to achieve a first temperature that is less than a second temperature associated with the environment. The ports include at least one inlet port and at least one outlet port. For example, in some embodiments, each inlet port and outlet port is arranged in the panel body. The fluid path is arranged between the inlet port and the outlet port. The heat exchanger includes a first port and a second port, and is coupled to the fluid paths of the plurality of cooling panels. The fluid enters the first port of the heat exchanger at a first temperature, and the fluid exits the second port at a second temperature that is greater than the first temperature.

In some embodiments, the cooling system includes a control system that is configured to control at least one operating parameter. The operating parameter can include one or more of a flow rate of a fluid in each fluid path, a temperature of the fluid entering at least one inlet port, and a temperature of the fluid exiting at least one outlet port.

In some embodiments, the cooling system includes a mechanism configured to change the angle of each of the plurality of cooling panels. In some embodiments, the cooling system includes an actuator coupled to the mechanism, wherein the control system is further configured to actuate the actuator to change the angle of each of the plurality of cooling panels.

In some embodiments, the cooling system includes a plurality of control valves coupled to each fluid path by the respective inlet port or respective outlet port. The control system is configured to control each control valve of the plurality of control valves to control a flow of a fluid among the fluid paths of the plurality of cooling panels. In some embodiments, for example, the control system is configured to control each control valve of the plurality of control valves to cause the fluid paths of the plurality of cooling panels to be in series. In some embodiments, for example, the control system is configured to control each control valve of the plurality of control valves to cause the fluid paths of the plurality of cooling panels to be in parallel. In some embodiments, the control valves are used to ensure uniform flow distribution through each row of panels. In some embodiments, the valves are used to isolate each row when filling the system with a fluid, to ensure no air bubbles remain in the panels and associated piping.

In some embodiments, the cooling system includes a pump for pumping the fluid through each fluid path of the plurality of cooling panels, and the control system is configured to control the pump. In some embodiments, a thermosyphon is used to circulate fluids through one or more of the cooling panels.

In some embodiments, the control system is configured to receive one or more sensor signals from one or more sensors. The one or more sensor signals is indicative of at least one of the group comprising a flow rate of a fluid in each fluid path, a temperature of the fluid entering at least one inlet port, a temperature of the fluid exiting at least one outlet port, a component temperature, the second temperature, a pressure indicative of the fluid, and a difference in pressure of the fluid.

In some embodiments, the cooling load is at least one of a refrigeration cycle, a cooling jacket of equipment, an air conditioning system, a thermal reservoir, and a coolant conditioning system.

In some embodiments, the plurality of cooling panels are arranged in an array.

In some embodiments, the cooling system includes a frame to which the plurality of cooling panels are mounted, and the plurality of cooling panels are oriented at an angle from the sun. In some embodiments, the angle is between 5 and 15 degrees, inclusive. In some embodiments, the angle is between 7 and 12 degrees, inclusive. In some embodiments, the plurality of cooling panels are oriented away from Earth's equator. For example, in some embodiments, the cooling panels are 37-41 inches wide and 75-79 inches long.

In some embodiments, each fluid path of the plurality of cooling panels is arranged in parallel such that each inlet port of the plurality of cooling panels is coupled together and each outlet port of the plurality of cooling panels is coupled together. Each inlet port receives a fluid at an inlet temperature, and each outlet port outputs the fluid at an outlet temperature less than the inlet temperature.

In some embodiments, the cooling panels include a first cooling panel, a second cooling panel, and a set of panels. Each fluid path of the cooling panels is arranged in series such that each inlet port of the plurality of cooling panels is coupled to an outlet of another cooling panel. The first cooling panel is arranged to receive a fluid at an inlet temperature, and the second cooling panel is arranged to output the fluid at an outlet temperature less than the inlet temperature. In some embodiments, one or more fluid conduits connecting cooling panels to the heat exchanger are insulated. For example, in some embodiments, only the return conduit (e.g., piping) from the outlet of the cooling panels to the inlet of the heat exchanger is insulated.

In some embodiments, the first set of radiative properties includes a reflectivity that reduces the amount of energy from irradiance at the film transmitted to the panel body.

In some embodiments, the fluid path of each cooling panel includes a recess in the panel body of the cooling panel.

In some embodiments, the fluid path of each cooling panel includes a tube affixed to the panel body of the cooling panel.

BRIEF DESCRIPTION OF THE DRAWINGS

The present disclosure, in accordance with one or more various embodiments, is described in detail with reference to the following figures. The drawings are provided for purposes of illustration only and merely depict typical or example embodiments. These drawings are provided to facilitate an understanding of the concepts disclosed herein and shall not be considered limiting of the breadth, scope, or applicability of these concepts. It should be noted that for clarity and ease of illustration these drawings are not necessarily made to scale.

DETAILED DESCRIPTION

Figure 1:
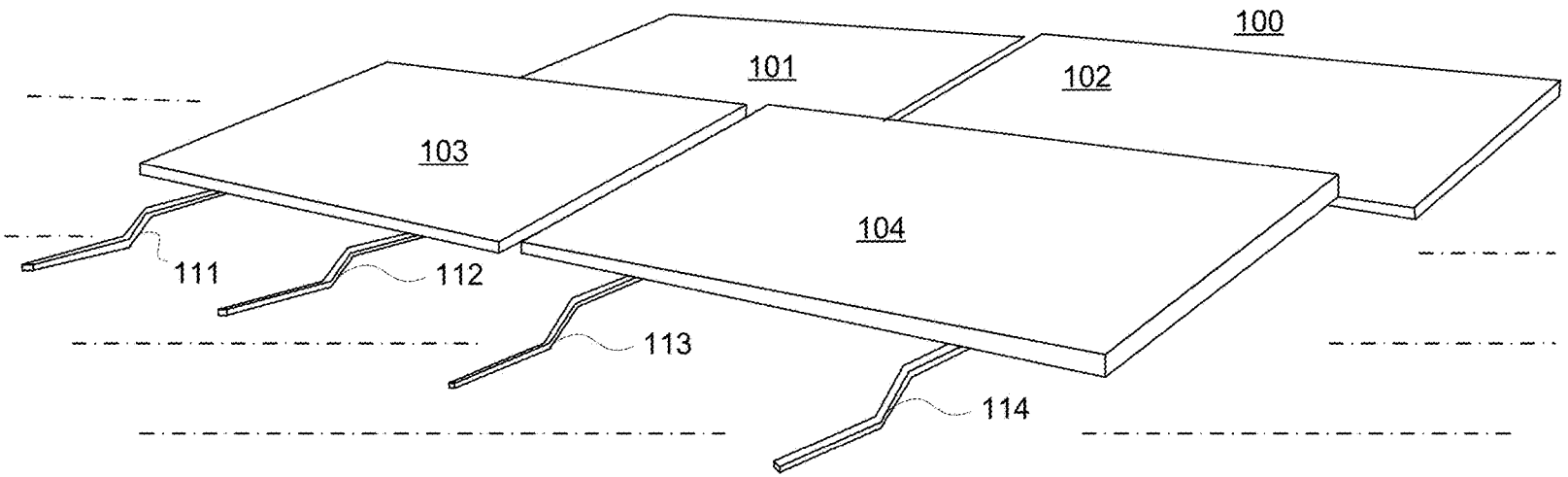
FIG. 1 shows a perspective view of an array of cooling panels, each having fluid ports, in accordance with some embodiments of the present disclosure.

In some embodiments, a panel is layered, having fluid channels and a film on one side. FIG. 1 shows a perspective view of array 100 of cooling panels 101, 102, 103, and 104, each having fluid ports 111, 112, 113, and 114, in accordance with some embodiments of the present disclosure. In some embodiments, each of cooling panels 101-104 is layered, having fluid channels and a film on one side. In some embodiments, each of cooling panels 101-104 includes a clear layer (e.g., infrared transparent), film layer, aluminum layer, any other suitable layer, or any suitable combination thereof. In some embodiments, thermal insulation is applied to one or more surfaces of one or more of cooling panels 101-104.

In some embodiments, any of cooling panels 101-104 may be constructed by affixing a first metal plate and a second metal plate, wherein the first metal plate includes channel features (e.g., the plates may be aluminum). In some embodiments, the side of the first metal plate that is exposed to the outside air may include a coating (e.g., be anodized, powder coated, covered in a potting material) to protect it from corrosion. The channel features, when the plates are adjoined, form channels configured as fluid conduits. For example, the channel features may be stamped or pressed into the sheet. A film having desired radiative properties is applied to one of the first and second metal plates. In an illustrative example, radiative properties may include a high emissivity in the infrared spectrum (e.g., mid-IR for heat rejection at the panel temperature), and low absorption in the solar spectrum (e.g., to prevent or otherwise reduce absorption of incident solar radiation). A protective covering is applied over the film. The protective covering may help shield the cooling panel from wind (e.g., convective heat transfer), reduce solar gain, protect the surface from dirt and debris, or a combination thereof. In some embodiments, a protective film is included during packaging to protect the radiative surface from being scratched. For example, the protective film may be removed or may remain on the surface during operation. In some embodiments, fluid flows through pipes in thermal contact with a flat surface of the panel. The flow path may be determined, for example, based on the channel length required to reach a desired outlet temperature, a desired heat rejection, or both, in a way that minimizes, or otherwise reduces, pressure drop through the panel. In some embodiments, the protective covering shields the film and panel from wind, reduces solar gain, and protects the surface from dirt and debris. The covering may include a material having suitable optical properties such as, for example, infrared transparency. In some embodiments, the shield is not in thermal contact with the panel, to reduce solar heat gain.

Figure 2:
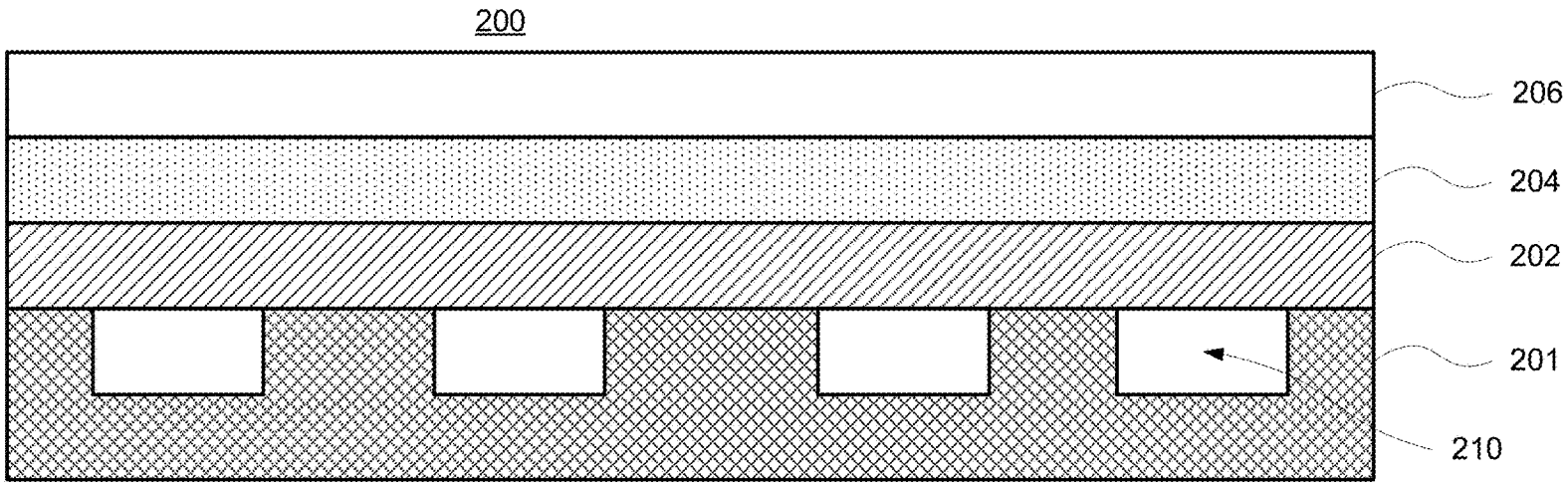
FIG. 2 shows a cross-sectional view of illustrative cooling panel 200, in accordance with some embodiments of the present disclosure.
Figure 3:
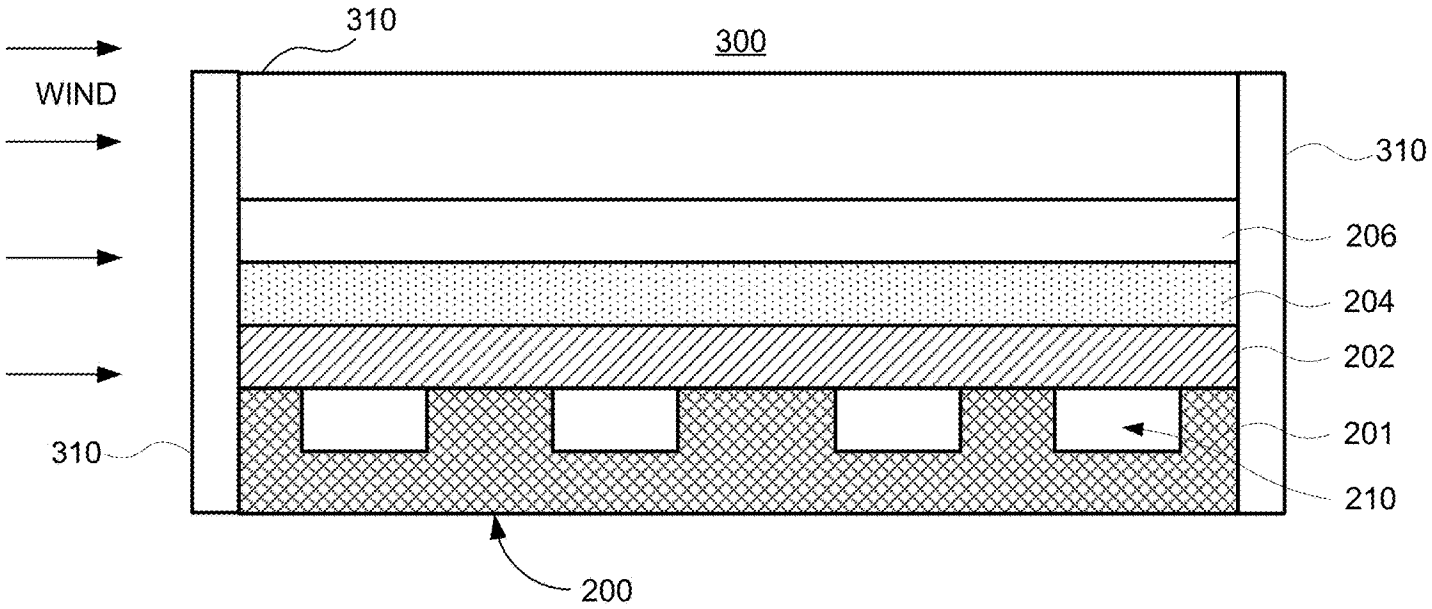
FIG. 3 shows a cross-sectional view of a configuration including the illustrative cooling panel of FIG. 2 with a windshield installed, in accordance with some embodiments of the present disclosure.
Figure 4:
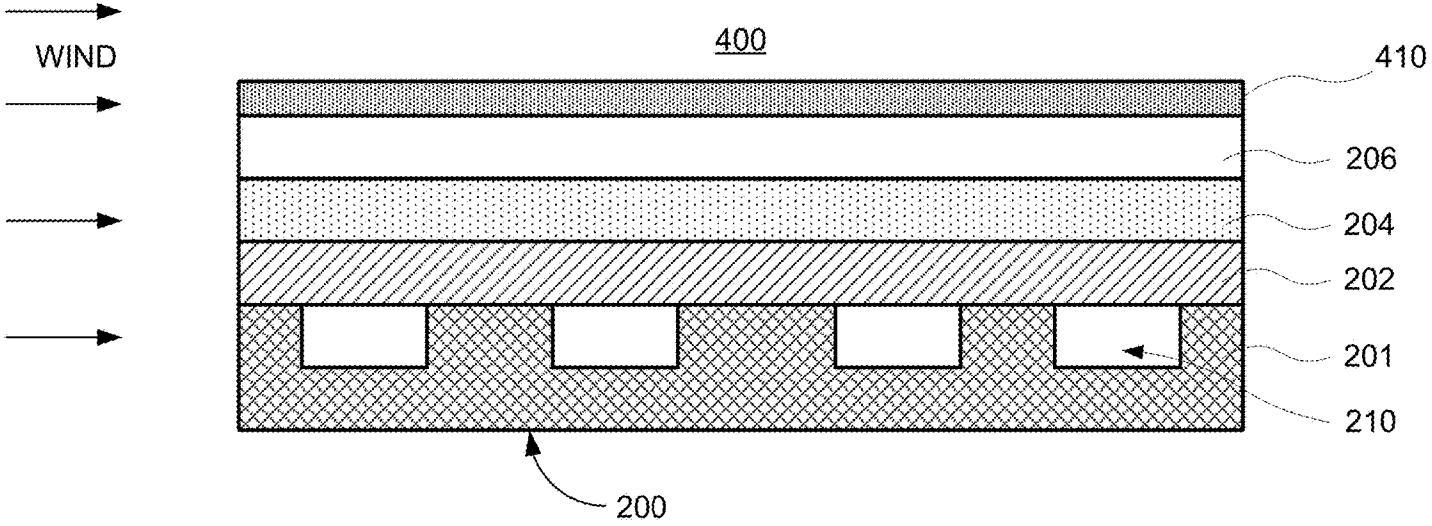
FIG. 4 shows another cross-sectional view of a configuration including the illustrative cooling panel of FIG. 2 with a windshield installed, in accordance with some embodiments of the present disclosure.

FIGS. 2-4 show illustrative cross sections of cooling panels having channels, films, plates, protective coverings, and optional windshields, in accordance with some embodiments of the present disclosure.

FIG. 2 shows a cross-section view of illustrative cooling panel 200, in accordance with some embodiments of the present disclosure. As illustrated, cooling panel 200 includes plate 201, plate 202, film 204, and protective covering 206. Cooling panel 200 includes fluid channels 210 in plate 201 that may be, for example, arranged in parallel, in a serpentine flow path, or in any other suitable arrangement. Any or all of cooling panels 101-104 of FIG. 1 may be the same as or similar to cooling panel 200 of FIG. 2.

FIG. 3 shows a cross-sectional view of configuration 300 including illustrative cooling panel 200 of FIG. 2 with windshield 310 installed, in accordance with some embodiments of the present disclosure. Windshield 310 is configured to reduce convection and associated convective heat transfer at the outer surface of cooling panel 200. Windshield 310 may help to, for example, reduce heat transfer from the ambient air to the surface of cooling panel 200 (e.g., when cooling panel 200 is at a temperature less than the ambient temperature). Windshield 310 may include a vertical surface (as illustrated), an extension from the surface (e.g., protective covering 206), any other suitable feature for reducing convective heat transfer at a surface of cooling panel 200, or any combination thereof. Windshield 310 may be, but need not be, in contact with cooling panel 200. For example, a gap may be included between windshield 310 and cooling panel 200 to allow for water to run off the surface (e.g., so that dirt and debris do not accumulate on the surface of cooling panel 200).

FIG. 4 shows a cross-sectional view of configuration 400 including illustrative cooling panel 200 of FIG. 2 with windshield 410 installed, in accordance with some embodiments of the present disclosure. Windshield 410 is configured to reduce convection and associated convective heat transfer at the outer surface of cooling panel 200. Windshield 410 may help to, for example, reduce heat transfer from the ambient air to the surface of cooling panel 200 (e.g., when cooling panel 200 is at a temperature less than the ambient temperature). Windshield 410 may include a film (as illustrated), a mesh, a covering arranged over the surface, an insulation layer, any other suitable feature for reducing convective heat transfer at a surface of cooling panel 200, or any combination thereof.

Figure 5:
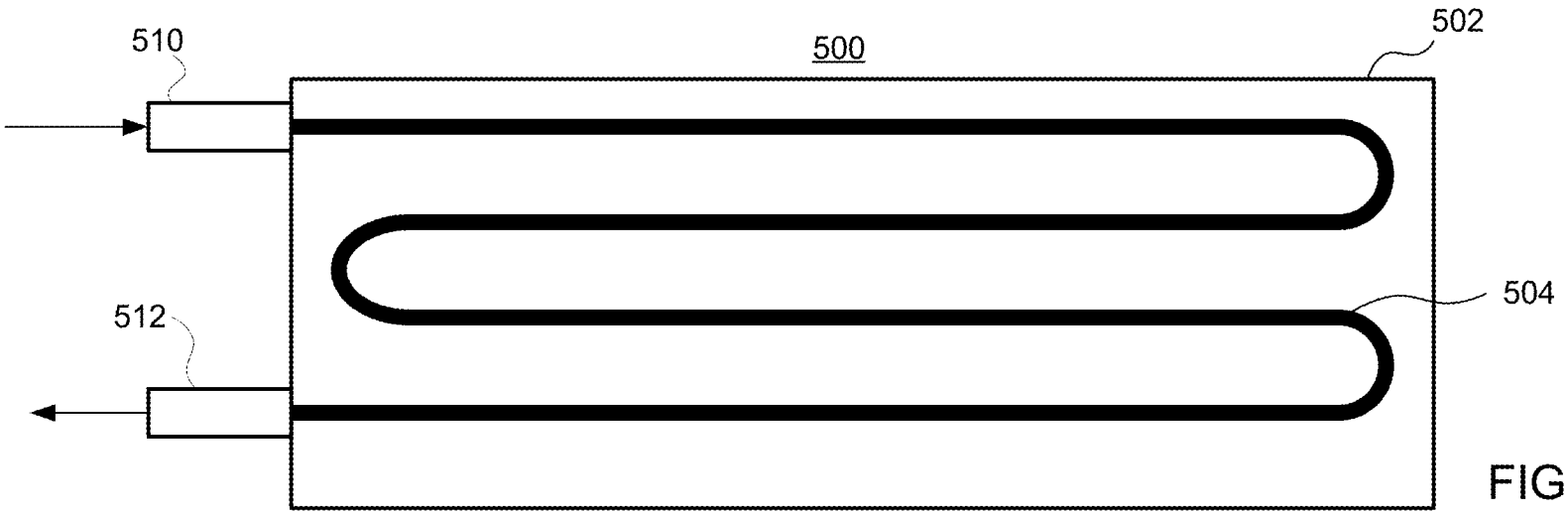
FIG. 5 shows a plan view of an illustrative cooling panel having serpentine channels, in accordance with some embodiments of the present disclosure.

FIG. 5 shows a plan view of illustrative cooling panel 500 having serpentine channels 504, in accordance with some embodiments of the present disclosure. For example, as illustrated, serpentine channel 504 may include a single flow path, that winds back and forth across cooling panel 500 (e.g., panel body 502 thereof) to provide cooling. One or more serpentine paths may be included in a cooling panel. Inlet port 510 and outlet port 512 may be arranged on a same side (as illustrated in FIG. 5), or different sides from each other.

Figure 6:
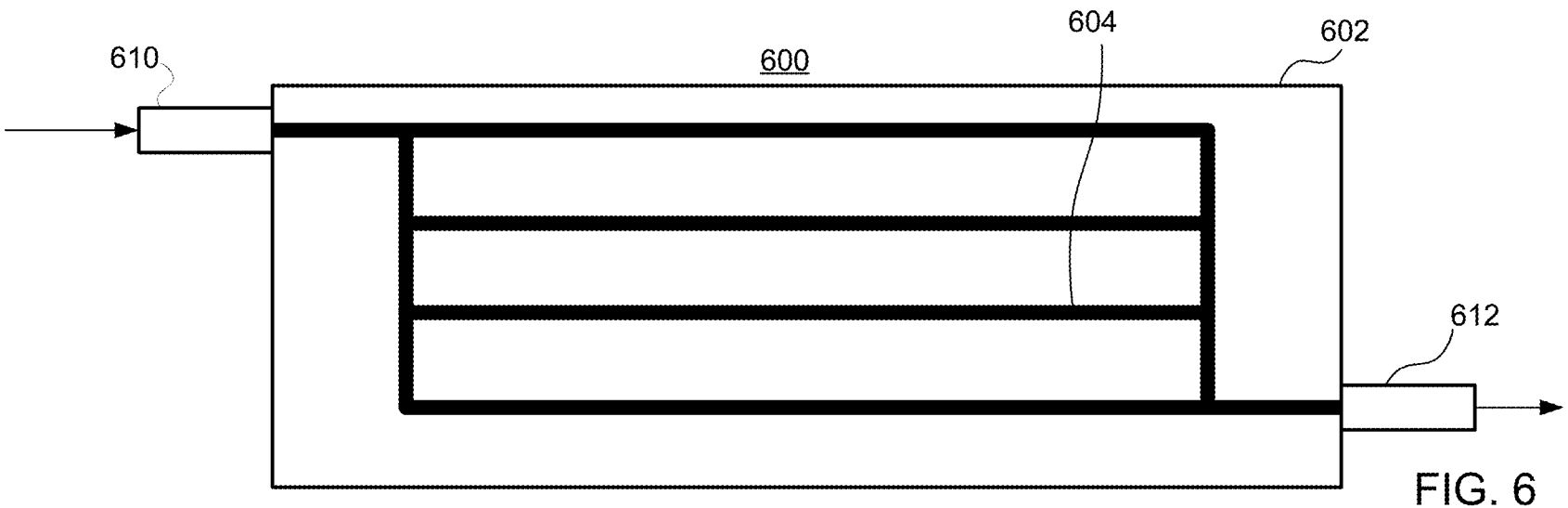
FIG. 6 shows a plan view of an illustrative cooling panel having parallel channels, in accordance with some embodiments of the present disclosure.

FIG. 6 shows a plan view of illustrative cooling panel 600 having parallel channels 604, in accordance with some embodiments of the present disclosure. For example, as illustrated, parallel channels 604 may include multiple flow paths (e.g., four as illustrated) in cooling panel 600 (e.g., panel body 602 thereof), that are coupled in parallel between inlet port 610 and outlet port 612. Inlet port 610 and outlet port 612 may be arranged on a same side (e.g., with suitable plenums or flow distribution features), or on different sides (e.g., as illustrated in FIG. 6).

Figure 7:
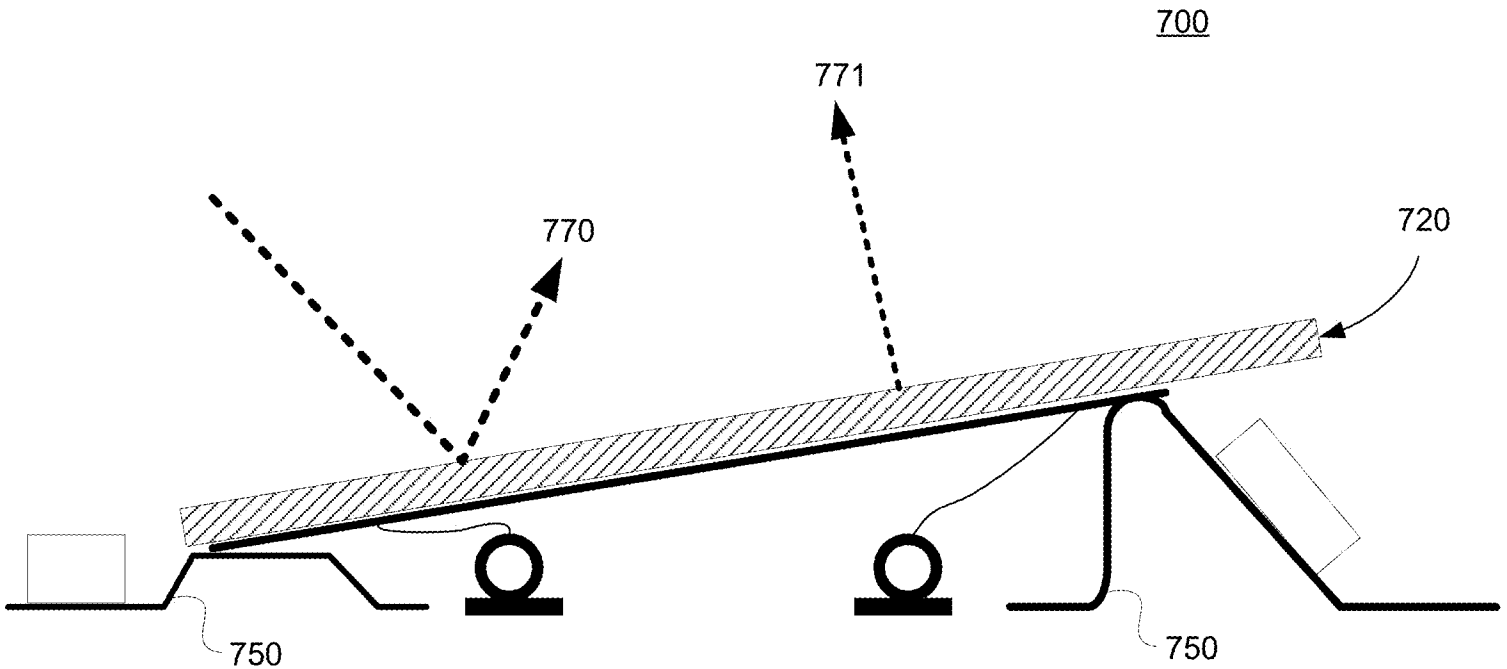
FIG. 7 shows a side view of a configuration including an illustrative cooling panel having illustrated radiative properties, mounted to a structure, in accordance with some embodiments of the present disclosure.

FIG. 7 shows a side view of a configuration 700 including cooling panel 720 having illustrated radiative properties (e.g., reflectivity 770 and emissivity 771), mounted to structure 750, in accordance with some embodiments of the present disclosure. Cooling panel 720 may include any suitable composition and construction in accordance with some embodiments of the present disclosure. For example, cooling panel 720 may be similar to any of the illustrative cooling panels of FIGS. 2-6. Table 1 shows illustrative temperature results in accordance with the present disclosure. It will be understood that any illustrated performance is included as being merely exemplary.

In some embodiments, an orientation of one or more cooling panels (e.g., any of the illustrative cooling panels of FIGS. 1-7) may be selected or controlled. For example, in some embodiments, a cooling panel is always angled slightly away from the sun (e.g., the radiating surface has an area normal vector slightly away from the sun). For example, a cooling panel may be angled between 5° and 15° away from the sun (e.g., to avoid direct solar radiation, but still have a large solid angle exposed to the sky). In a further example, a cooling panel may be angled to be self-cleaning (e.g., such that dust or debris washes away due to gravity). In a further example, a cooling panel may be angled to reduce solar heating. In some embodiments,

TABLE 1

Illustrative temperatures of a cooling panel and surroundings.

| Component or System | Description | Illustrative Temperature |
|---|---|---|
| Sky Temperature | Temperature of space (e.g., from radiation to outside of atmosphere) | Extremely lower than ambient temperature (e.g., −14.7° F. during one experiment) |
| Ambient Temperature | Temperature of environment (e.g., air and other surfaces) | Within the range experience on the Earth's surface (e.g., 73.9° F. during the experiment) |
| Panel Surface Temperature | Temperature at outward cooling panel surface | Either greater than or less than the ambient temperature depending on cooling load (e.g., 59.9° F. during the experiment) |

cooling panels are oriented away from walls or other surfaces that can transfer heat (e.g., via infrared radiation) to the cooling panels.

In some embodiments, a control system (e.g., control system 1500 of FIG. 15) is used to control orientation of one or more cooling panels (e.g., anti-tracking of sun). For example, an array, or one or more cooling panels thereof, may be mounted to a mechanism coupled to an actuator that is configured to change the orientation of the one or more cooling panels.

In some embodiments, a cooling system may include a windshield for the panels, configured to block or otherwise reduce wind velocity near the panels (e.g., as illustrated in FIGS. 3-4, or otherwise). For example, as cooling panels are operated at lower temperatures, a windshield may reduce convective heat transfer to the panels from the environment (e.g., thus impacting the panel temperature).

In some embodiments, a cooling panel system may function as a direct condenser or heat exchanger (e.g., an add-on system or direct heat rejection system). In some embodiments, a cooling panel system may be installed in series or parallel with another heat exchanger or condenser. In some embodiments, a cooling panel may be coupled (e.g., piped together), in a reverse return layout to ensure equal, or near equal, flow through cooling panels coupled in parallel. In some embodiments, one or more balancing valves (e.g., control valves) are included and used to set or otherwise adjust the flowrate through one or more cooling panels, or rows of cooling panels, in an array. In some embodiments, all of the piping (e.g., supplies and returns) between cooling panels and the heat exchanger is insulated. In some embodiments, only the return piping from the outlet of one or more cooling panels to the heat load is insulated.

In some embodiments, a cooling panel system may be sized based on an actual cooling load, expected cooling load, peak cooling load, available area, any other suitable criterion, or any combination thereof. For example, a cooling panel array may be sized (e.g., number of panels, size of panels, layout of panels, or a combination thereof) to provide a desired peak cooling or average cooling. In some embodiments, the number of cooling panels is determined based on the name plate capacity of the unit (e.g., a specified cooling load, a target cooling load) or an actual measured cooling capacity provided by the system (e.g., a measured cooling load).

In some embodiments, a cooling panel (e.g., any of the illustrative cooling panels of FIGS. 1-7) array may be sized for sub-cooling. In an illustrative example, a sizing determination may include 2-4 square meters ($m^2$) of panels per ton of cooling, or a flow rate of 0.3 to 0.5 LPM/$m^2$ based on a desired change in temperature ($\Delta T$) and heat rejection capacity. In some embodiments, 5 to 7 $m^2$ of panels per ton of heat rejection can be used to replace a condenser based on the desired approach of the temperature to the ambient temperature. In some embodiments, panels can be used to cool fluids leaving a compressor or cool a compressor. In some embodiments, the fluid flowing through the panel will include water mixed with a corrosion inhibitor and a fluid to prevent the mixture from freezing. In some embodiments, outlet piping from the panels and the inlet piping to the panels are thermally insulated. In some embodiments, it is desired to insulate the outlet piping from the panels, and not insulate the inlet piping. In some embodiments, it is desirable to insulate some fraction of the panel, when the fluid is cooled below the ambient temperature, and not insulate the portion of the panel where the fluid temperature is above the ambient temperature.

FIGS. 8-15 show illustrative cooling systems, in accordance with some embodiments of the present disclosure. A cooling system may include cooling panels to reject energy as heat supplied by a refrigeration cycle, a cooling jacket of equipment, an air conditioning system, a thermal reservoir, a coolant conditioning system (e.g., such as an intermediate cooling loop, a system for providing coolant to multiple systems), any other suitable cooling load, or any combination thereof. For example, a coolant conditioning system may be configured to provide coolant at predetermined conditions (e.g., values of temperature, pressure, enthalpy, flow rate, density, phase(s), or other properties) for cooling.

Figure 8:
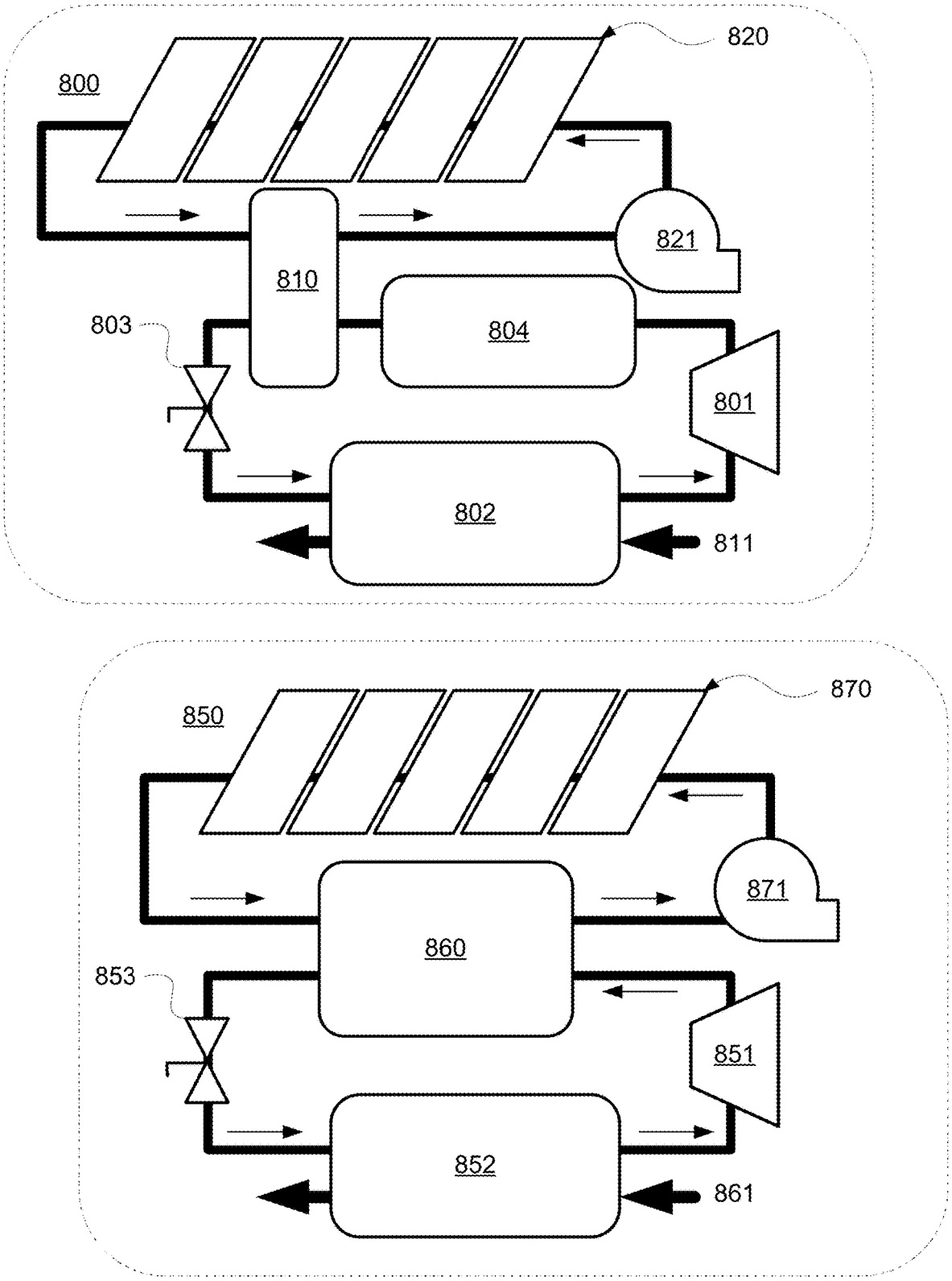
FIG. 8 shows system diagrams of two illustrative cooling system configurations: a sub-cooler and a remote condenser, in accordance with some embodiments of the present disclosure.

FIG. 8 shows two system diagrams of two illustrative cooling system configurations: sub-cooler system 800 and remote condenser system 850, in accordance with some embodiments of the present disclosure. Illustrative performance results include about a 15% savings for sub-cooler system 800 and about a 30% savings for remote condenser system 850, although it will be understood that performance metrics are merely exemplary.

Sub-cooler system 800 includes a refrigeration cycle including compressor 801, evaporator 802, valve 803 (e.g., a throttle valve, or other suitable flow restriction), and condenser 804 coupled to heat exchanger 810, which transfers heat to a cooling cycle including cooling panels 820 and pump 821. Heat exchanger 810 of sub-cooler system 800 illustrated in FIG. 8 may include a parallel flow heat exchanger, a cross flow heat exchanger, a co-flow heat exchanger, any other suitable type of heat exchanger, or any combination thereof. Compressor 801, evaporator 802, valve 803, and condenser 804 may include any suitable types of respective components that may be used in, for example, a refrigeration cycle.

Cooling load 811 may arise from any process, and may include, for example, a liquid phase coolant, a two-phase coolant, a gaseous coolant, a slurry, or any combination thereof. The refrigeration cycle functions to transfer heat from cooling load 811 to heat exchanger 810, and then to the second cooling cycle. Heat from cooling load 811 is then rejected by cooling panels 820 to the atmosphere (e.g., via radiation and convection). In an illustrative example, the refrigeration cycle may include an existing cycle, to which heat exchanger 810 and the cooling cycle may be added (e.g., retrofitted). Heat exchanger 810, pump 821, cooling panels 820, and any other suitable components, plumbing, and instrumentation may be retrofitted to the refrigeration cycle to allow heat transfer to the environment via cooling panels 820.

Remote condenser system 850 includes a refrigeration cycle including compressor 851, evaporator 852, valve 853 (e.g., a throttle valve, or other suitable flow restriction), and condensing heat exchanger 860, which transfers heat to a cooling cycle including cooling panels 870 and pump 871. Condensing heat exchanger 860 of remote condenser system 850 illustrated in FIG. 8 may include a parallel flow heat exchanger, a cross flow heat exchanger, a co-flow heat exchanger, any other suitable type of heat exchanger, or any combination thereof. Compressor 851, evaporator 852, and valve 853 may include any suitable types of respective components that may be used in, for example, a refrigeration cycle.

Cooling load 861 may arise from any process, and may include, for example, a liquid phase coolant, a two-phase coolant, a gaseous coolant, a slurry, or any combination thereof. The refrigeration cycle functions to transfer heat from heat from cooling load 861 to heat exchanger 860, and then to the cooling cycle. Heat from cooling load 861 is then rejected by cooling panels 870 to the atmosphere (e.g., via radiation and convection). In an illustrative example, the refrigeration cycle may include an existing cycle, to which condensing heat exchanger 860 and the cooling cycle may be added (e.g., retrofitted). Condensing heat exchanger 860, pump 871, cooling panels 870, and any other suitable components, plumbing, and instrumentation may be retrofitted to the refrigeration cycle to allow heat transfer to the environment via cooling panels 870. Condensing heat exchanger 860 may replace an existing condenser, which may be removed during the retrofit. For example, a condenser installed in the refrigeration cycle (similar to that illustrated in sub-cooler system 800) may be removed, and condensing heat exchanger 860 may be installed to provide greater cooling, greater savings, or both.

Figure 9:
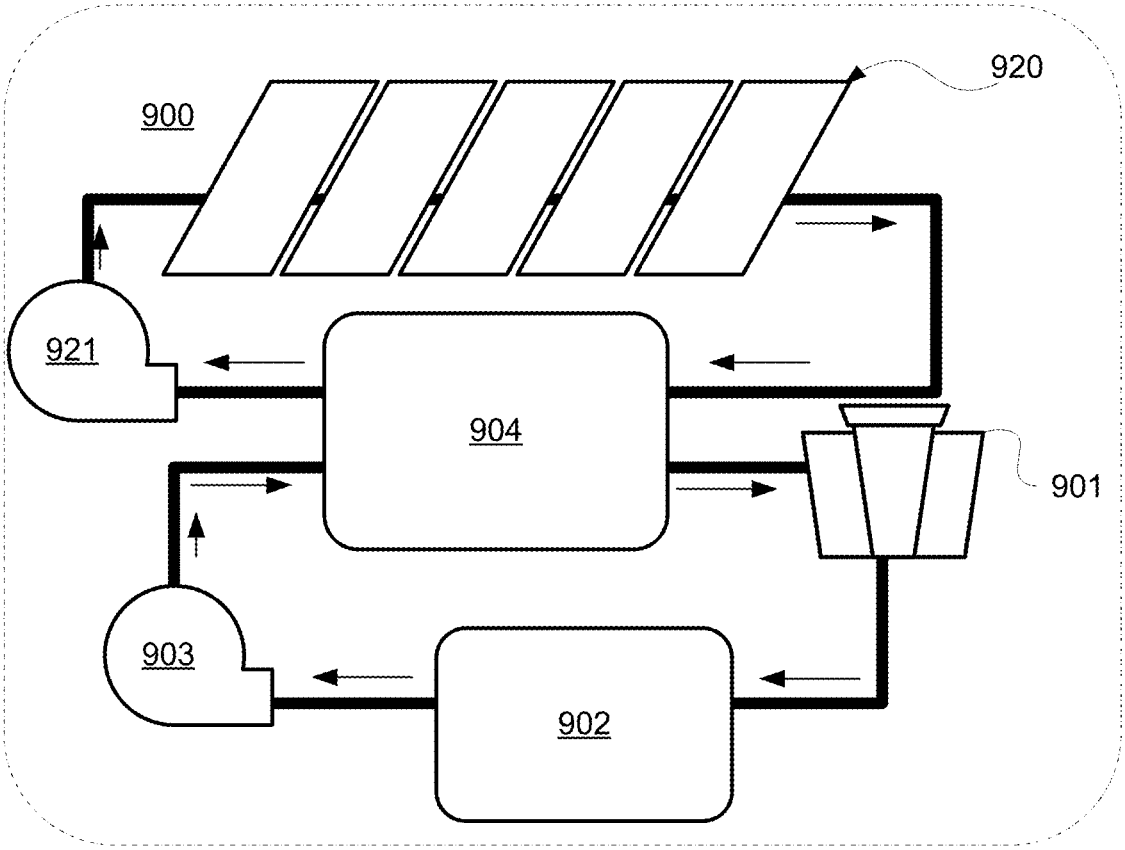
FIG. 9 shows a system diagram of two illustrative cooling systems, in accordance with some embodiments of the present disclosure.
Figure 9:
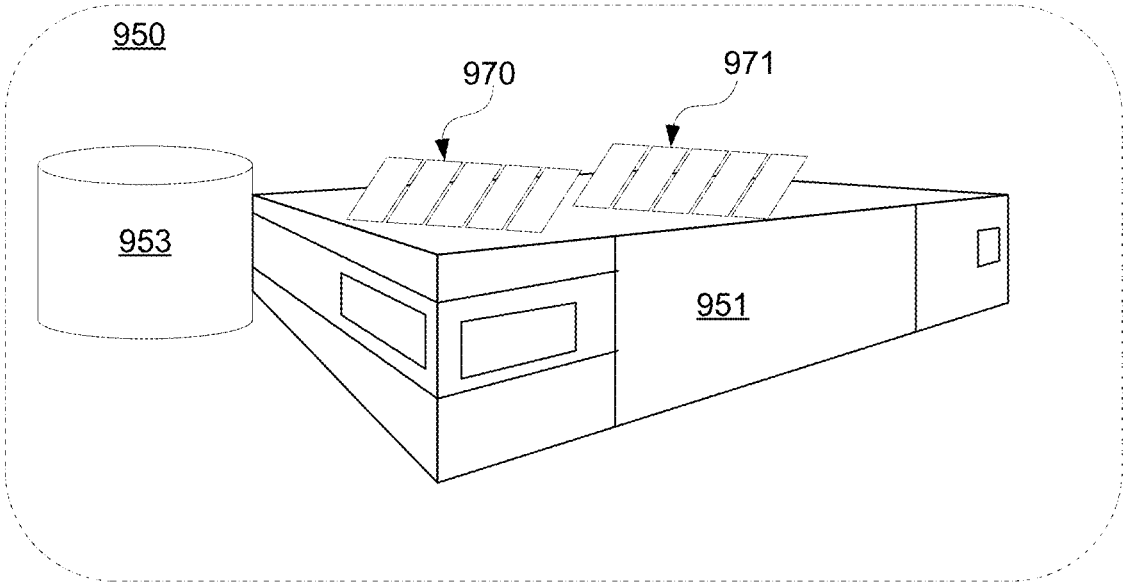

FIG. 9 shows a system diagram of illustrative cooling system 900 and illustrative cooling system 950, in accordance with some embodiments of the present disclosure. Illustrative performance results include 30% savings and reduced water usage for direct cooling of a data center using cooling system 900, and 40% to 60% savings by replacement of an AC unit with cooling system 950, although it will be understood that performance metrics are merely exemplary.

Cooling system 900 includes a first cooling loop that includes pump 903, a first set of passages of heat exchanger 904, and condenser 901 and it receives heat from thermal load 902. Cooling system 900 includes a second cooling loop that includes pump 921, cooling panels 920, and a second set of passages of heat exchanger 904.

Cooling system 950 includes two arrays 970 and 971 of cooling panels coupled to a cooling load of building 951 and also coupled to thermal storage tank 953. Thermal storage tank 953 is configured to store energy (e.g., using a fluid or mixture of fluids in a single phase or multiple phases).

Figure 10:
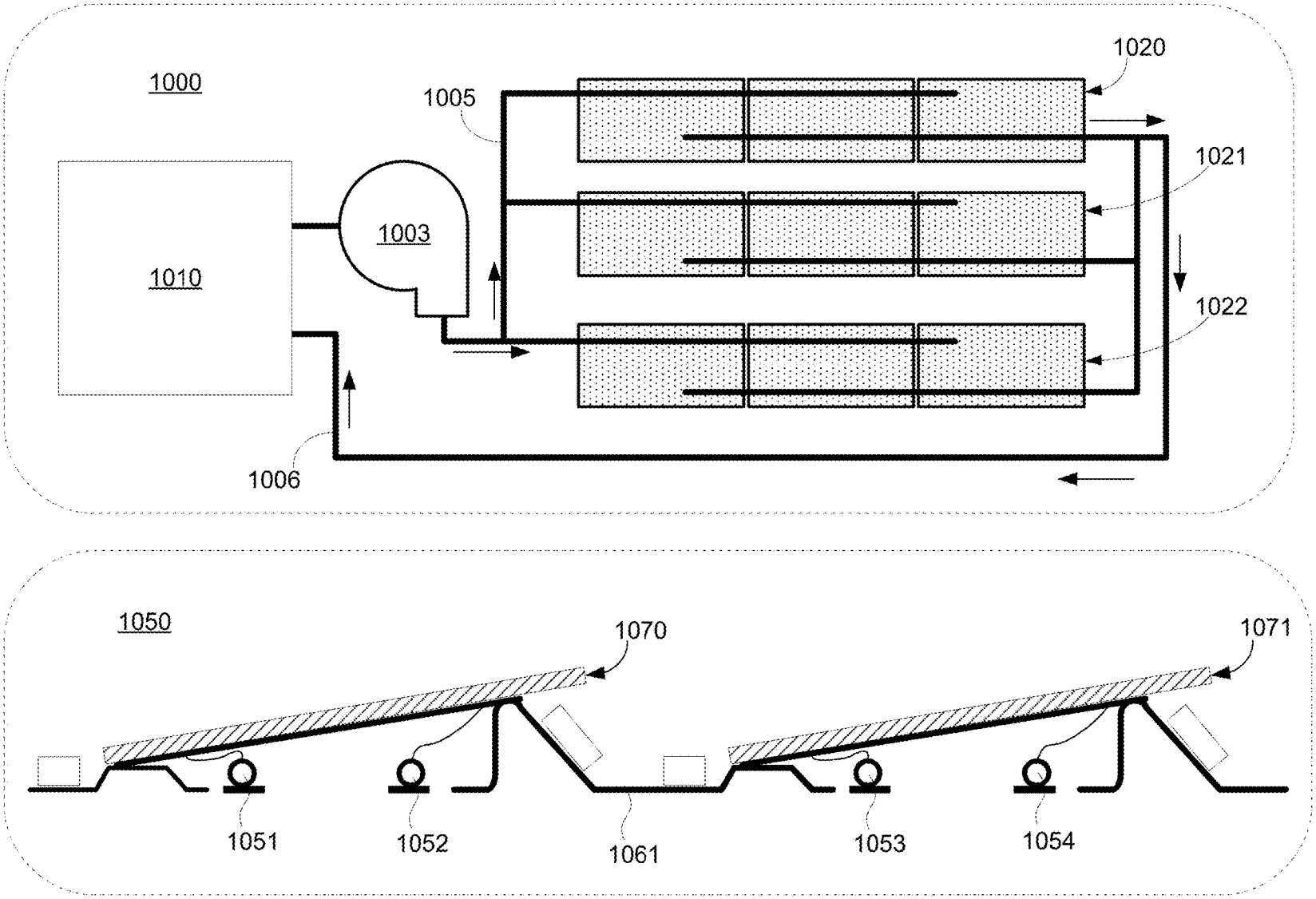
FIG. 10 shows an illustrative cooling system, and an illustrative cross-section of a cooling panel array, in accordance with some embodiments of the present disclosure.

FIG. 10 shows illustrative cooling system 1000, and an illustrative cross section of a cooling panel array 1050, in accordance with some embodiments of the present disclosure.

Cooling system 1000 includes pump 1003 coupled to cooling panel arrays 1020, 1021, and 1022 by fluid conduits 1005 and 1006. Cooling system 1000 may be sized based on thermal load 1010, by sizing pump 1003, changing operation of pump 1003 (e.g., changing a motor or pump speed to change flow rate), by increasing or decreasing the number of cooling panel arrays, increasing or decreasing the number of cooling panels in each array, or a combination thereof. For example, as illustrated, cooling system 1000 includes three cooling panel arrays (e.g., cooling panel arrays 1020, 1021, and 1022), but could optionally include one, two, three, or more than three cooling panel arrays. Fluid conduits 1005 and 1006, as illustrated, are coupled to passages of cooling panel arrays 1020, 1021, and 1022, which are arranged in parallel. A suitable fluid is pumped by pump 1003 through fluid conduit 1005, into passages of cooling panel arrays 1020-1022, and then into fluid conduit 1006, where the fluid is returned to thermal load 1010. In some embodiments, pump 1003 may be arranged downstream of the cooling panels (e.g., cooling panel arrays 1020-1022, as illustrated). In some embodiments, not illustrated, cooling system 1000 may include thermal storage, multiple pumps, flow control valves, sensors (e.g., to sense pressure, temperature, or differences thereof), bypass flow paths, de-aerators, fill ports, fluid-compatible fittings (e.g., of any suitable type), manifolds, distribution blocks, any other components not illustrated in FIG. 10, or any combination thereof.

Cooling system 1050 includes an array of cooling panels 1070 and 1071, which are mounted to frame 1061. Cooling panels 1070 are coupled to inlet conduit 1051 and outlet conduit 1052. Cooling panels 1071 are coupled to inlet conduit 1053 and outlet conduit 1054. In an illustrative example, outlet conduit 1052 may be coupled to inlet conduit 1053, thus arranging cooling panels 1071 in series with cooling panels 1070. In an illustrative example, inlet conduit 1051 may be coupled to inlet conduit 1053, and outlet conduit 1052 may be coupled to outlet conduit 1054, thus arranging cooling panels 1071 in parallel with cooling panels 1070. In some embodiments, pipes (e.g., any or all of fluid conduits 1051-1054) are arranged behind the cooling panel so that they are shaded from the sun (e.g., positioned opposite from the outer surface). Although two rows of cooling panels are illustrated in FIG. 10 as part of cooling system 1050, any suitable number of rows of cooling panels may be included and mounted to one or more frames or frame members.

Figure 11:
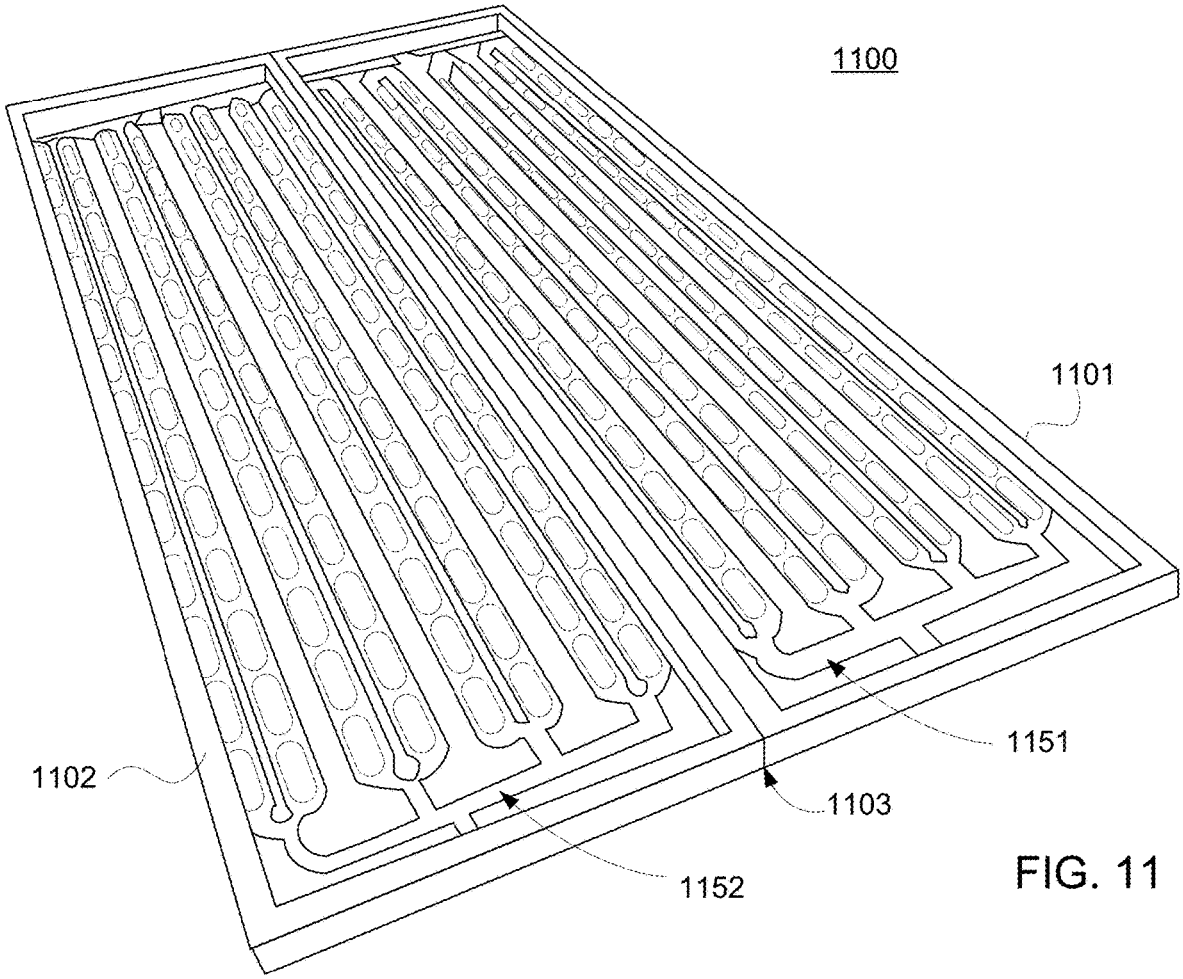
FIG. 11 shows a perspective view of an illustrative cooling panel, from the back, including cooling channels, in accordance with some embodiments of the present disclosure.

FIG. 11 shows a perspective view of cooling panel 1100, from the back, including cooling channels 1151 and 1152, in accordance with some embodiments of the present disclosure. Cooling panel 1100 includes body 1101 and body 1102 joined at seam 1103. As illustrated, cooling channels 1151 are formed in body 1101, and cooling channels 1152 are formed in body 1152. Cooling channels 1151 and cooling channels 1152 are not connected internally, as illustrated, but may optionally be coupled together in series or parallel using any suitable combination of fittings and fluid conduits. Cooling channels 1151 and 1152 may be formed using any suitable technique such as, for example, stamping sheet metal to form channels, affixing formed sheets together (e.g., by brazing, soldering, or welding), affixing tubes or other enclosed channels to the respective body (e.g., by brazing, soldering, or welding).

Figure 12:
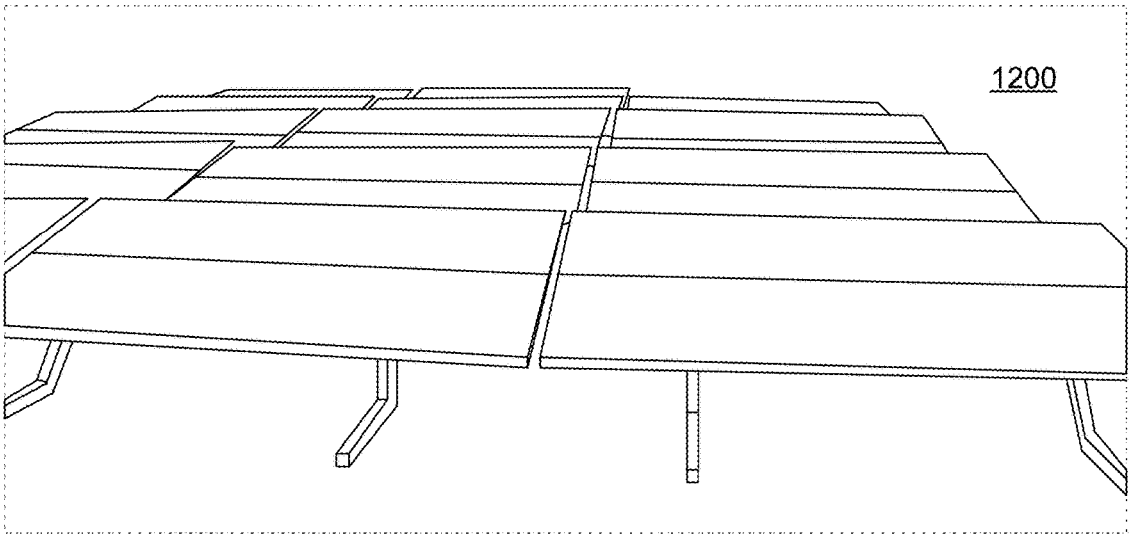
FIG. 12 shows a front elevated view of an illustrative cooling panel array, in accordance with some embodiments of the present disclosure.
Figure 13:
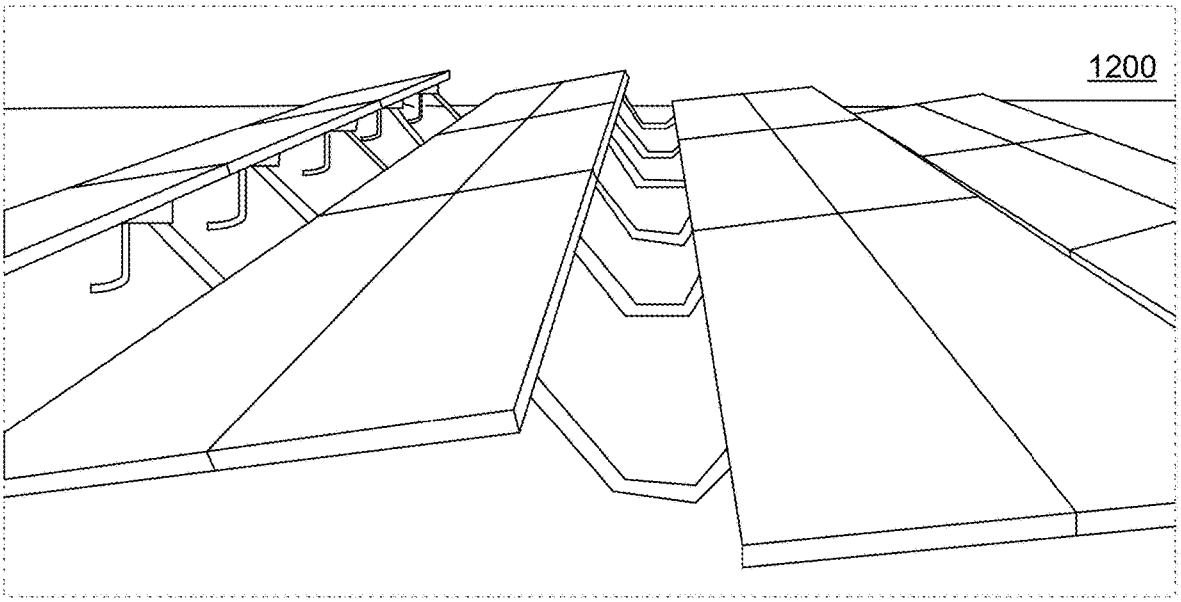
FIG. 13 shows an elevated side view of the illustrative cooling panel array of FIG. 12, in accordance with some embodiments of the present disclosure.

FIG. 12 shows a front elevated view of illustrative cooling panel array 1200, in accordance with some embodiments of the present disclosure. FIG. 13 shows an elevated side view of illustrative cooling panel array 1200 of FIG. 12, in accordance with some embodiments of the present disclosure. In some embodiments, cooling panels of cooling panel array 1200 are each angled away from the sun (e.g., flat or slightly to the North in the Northern hemisphere). In some embodiments, each cooling panel, or row of cooling panels, of cooling panel array 1200 may be articulated using one or more actuators (e.g., to change the angle of the panels). For example, an electric motor may be used with a gearset or pulley drive to rotate the panels to a desired orientation.

Figure 14:
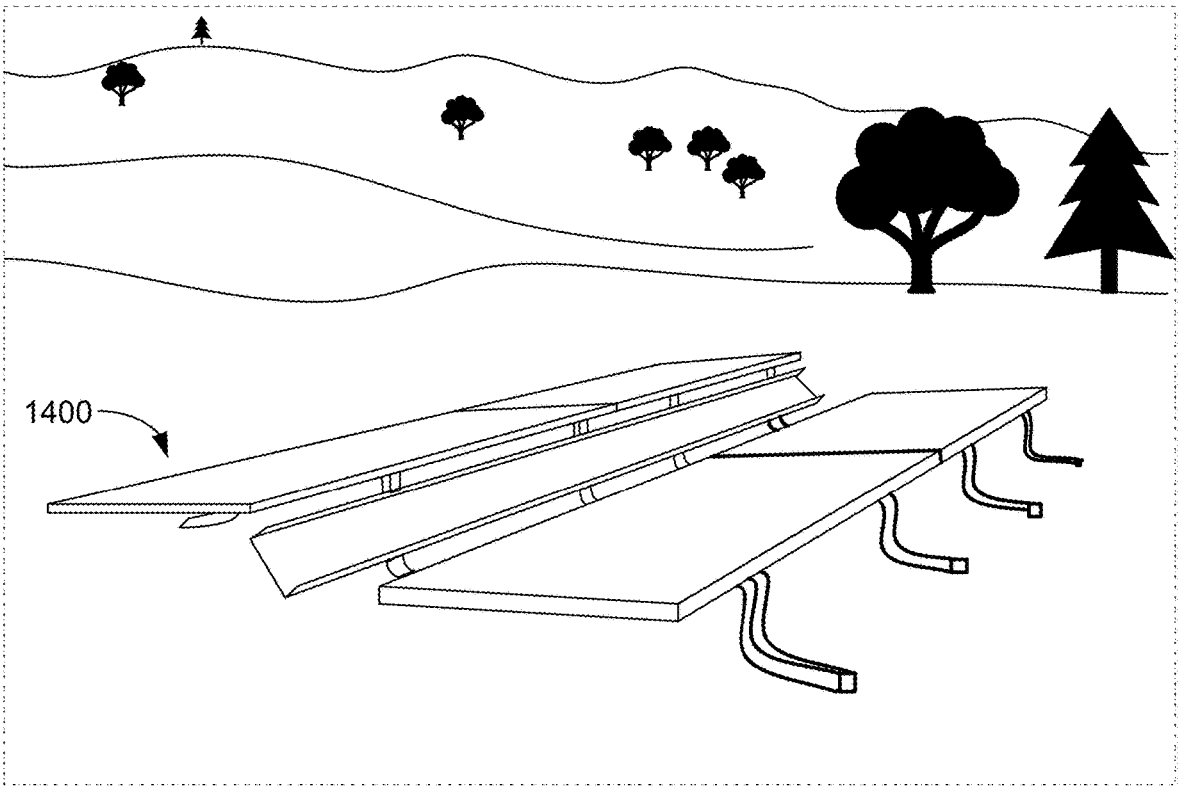
FIG. 14 shows an elevated rear view of an illustrative cooling panel array installed on the ground, in accordance with some embodiments of the present disclosure.

FIG. 14 shows an elevated rear view of illustrative cooling panel array 1400 installed on the ground, in accordance with some embodiments of the present disclosure. As illustrated, cooling panel array 1400 is installed remotely to provide cooling for a remote process, or any other suitable cooling load, in accordance with some embodiments of the present disclosure.

In some embodiments, a control system is configured to manage, monitor, or both one or more aspects of a cooling system. For example, a control system may be configured to control a flow rate (e.g., of a coolant), a pressure (e.g., of a coolant), a temperature (e.g., of a coolant, a surface, or a solid), an amount of heat transfer (e.g., of a coolant, a surface, or a solid), any other suitable property, or any combination thereof. For example, a control system may be configured to control a cooling system having cooling panels with desired radiative properties. A control system may include control circuitry, one or more communications interfaces, electrical components, sensors, any other suitable components, or any combination thereof.

Figure 15:
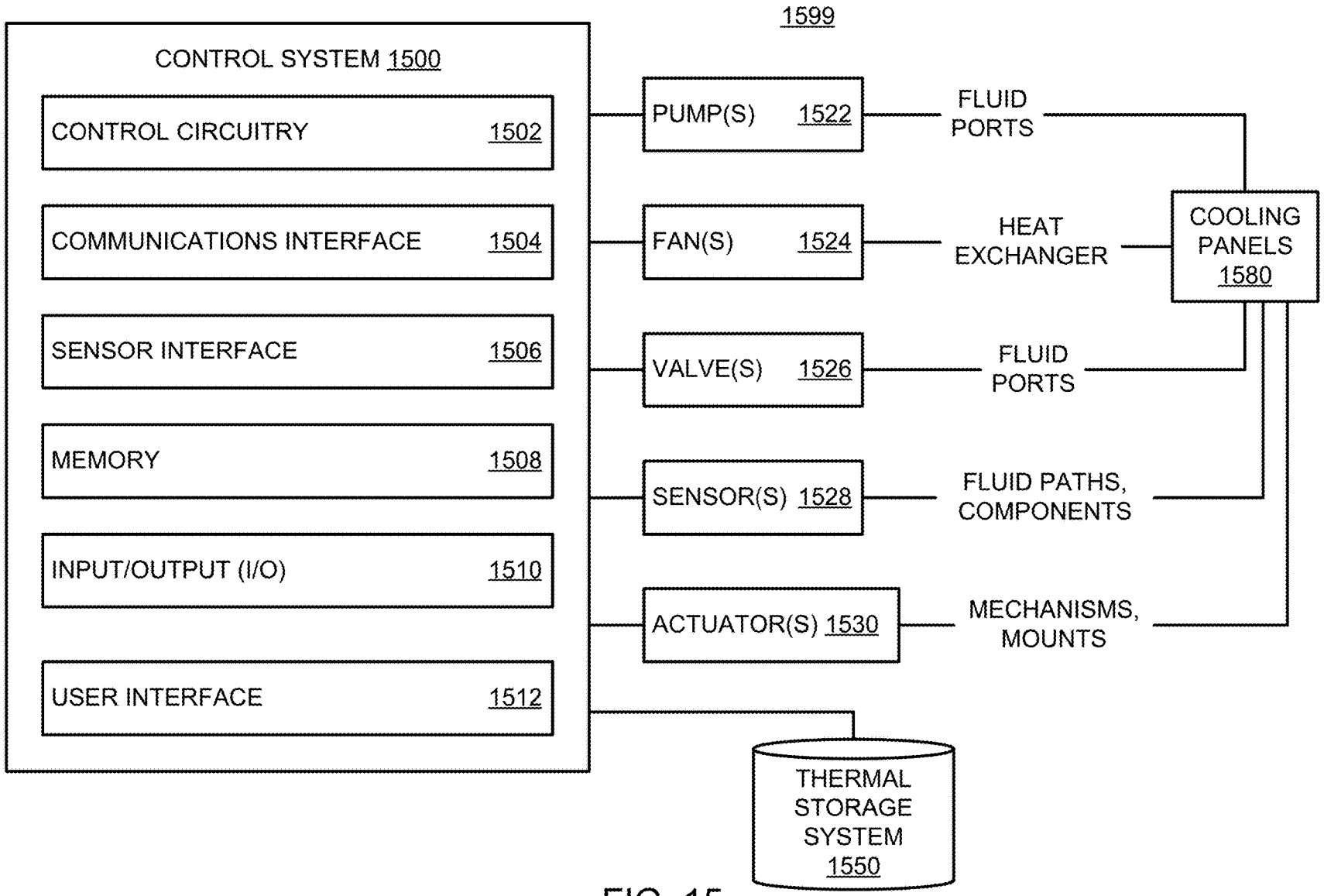
FIG. 15 shows a block diagram of an illustrative cooling system including a control system, in accordance with some embodiments of the present disclosure.

FIG. 15 shows a block diagram of illustrative cooling system 1599 including control system 1500, in accordance with some embodiments of the present disclosure. Control circuitry 1502 may include, for example, processing equipment configured to execute program instructions. Control circuitry 1502 may include bus lines, interfaces, clocks, and any other suitable hardware to send and recall information from memory 1508, communications interface 1504, sensor interface 1506, input/output (I/O) 1510, user interface 1512, any other suitable equipment or subsystem, or any suitable combination thereof.

Communications interface 1504 may include hardware and software configured for communicating information using one or more communications protocols. For example, communications interface 1504 may include an ethernet interface, wireless interface, an interface to a cellular network, an optical interface, any other suitable interface, or any combination thereof. Communications interface 1504 may include, for example, ports, connectors, or terminals for coupling to a wired network or optical network. In an illustrative example, communications interface 1504 may be configured to communicate using or based on transmission control protocol (TCP), user datagram protocol (UDP), Modbus, CANbus, any other suitable serial or parallel communications protocol implemented on any suitable hardware layer, or any combination thereof.

Sensor interface 1506 may include hardware and software configured for sending and receiving signals to and from sensors. For example, sensor interface 1506 may include an analog-to-digital converter (ADC), electrical terminals, a power supply, a signal conditioner, any other suitable components, or any combination thereof.

Memory 1508 may include any suitable memory type configured to store computer-readable instructions, data, any other suitable information, or any combination thereof.

Input/output 1510 may include general purpose I/O (GPIO), electrical terminals (e.g., for analog or digital communication), switches, relays, a power supply, any other suitable equipment or components, or any combination thereof.

User interface 1512 may include a keyboard, a mouse, a touchscreen, a display, a speaker, a microphone, any other suitable equipment configured to receive input from a user, any other suitable equipment to provide indications or information to a user, or any combination thereof.

Control system 1500 may be configured to control one or more pumps 1522, one or more fans 1524, one or more valves 1526, one or more sensors 1528, one or more actuators 1530, any other suitable components, or any combination thereof. For example, control system 1500 may be configured to adjust and maintain a speed of one or more pumps 1522 (e.g., via a motor controller of I/O 1510), a speed of one or more fans 1524 (e.g., via a motor controller of I/O 1510), a position (e.g., open, closed, partially open) of one or more valves 1526 (e.g., via a relay of I/O 1510), or a combination thereof. In a further example, control system 1500 may be configured to adjust and maintain an orientation of one or more cooling panels of cooling panels 1580 by actuating one or more actuators 1530 (e.g., which may be affixed to a mechanism coupled to the panels). In some embodiments, control system 1500 may be configured to control components based on feedback from one or more sensors 1528. For example, sensors 1528 may include a voltage sensor, a current sensor, a temperature sensor, a pressure sensor, a flow sensor, an optical sensor for detecting light, any other suitable sensor, or any combination thereof. Control system 1500 may determine an electrical power, a cooling power, a temperature difference, a load metric (e.g., percentage of full cooling load), an efficiency, a performance metric, or any other suitable metric based on input from sensors 1528.

In some embodiments, control system 1500 may be configured to control a fan (e.g., controlling an on state, off state, speed, or duty cycle), a pump (e.g., controlling motor speed, flow rate, or fluid pressure), flow path (e.g., via one or more actuated valves), an actuator coupled to a mount of one or more cooling panels (e.g., controlling orientation of a panel of cooling panels 1580), any other suitable equipment, or any combination thereof.

In some embodiments, control system 1500 controls a flow rate of a coolant, refrigerant, or other fluid based on one or more sensor inputs. For example, control system 1500 may control the flow rate based on season (e.g., which may impact use patterns and environmental conditions), time of day (e.g., which may impact use patterns and environmental conditions), the current state of one or more components, (e.g., whether certain flow paths are open or closed), based on any other suitable criterion or input, or any combination thereof.

In some embodiments, cooling system 1599 includes or is coupled to thermal storage system 1550. For example, in some embodiments, cooling panels are integrated with thermal storage system 1550. In a further example, thermal storage system 1550 may be charged/cooled when the underlying system that cooling panels 1580 are connected to is not running. In this way, the panels can be utilized all day long. Thermal storage system 1550 may include, for example: phase change materials, liquid stored in an insulated tank, waxes, any suitable material that goes from a liquid to solid state (e.g., where the phase change process occurs as a result of the cooling from the panels). An illustrative example includes replacing an air conditioning unit with a cooling system that includes cooling panels 1580 and thermal storage system 1550. The use of cooling panels 1580 and thermal storage system 1550 may help reduce the number of cooling panels in a deployment, increase the utilization of the panels, or both.

In some embodiments, cooling panels 1580 form a cooling panel array that may be installed at a suitable location in a fluid circuit. For example, a cooling panel array may be installed upstream of a condenser.

In some embodiments, control system 1500 may be configured to maintain a surface temperature of one or more cooling panels of cooling panels 1580 below atmospheric temperature (e.g., a local air temperature).

In some embodiments, a single installation (e.g., at a single site, having a common control system similar to control system 1500) may be used for more than one cooling application. For example, a cooling manifold may be used to distribute coolant to one or more fluid paths. In an illustrative example, a manifold may include a fixed flow distribution (e.g., fixed geometry), distributing flow to a plurality of heat exchangers. In a further example, a manifold may include one or more ports coupled to a controllable valve of valves 1526 (e.g., an electric ball valve or other suitable valve controlled by an electrical signal). Control system 1500 may be configured to shut off fluid flow to one or more heat exchangers if, for example, a corresponding compressor is not running. Accordingly, control system 1500 may be configured to direct flow and/or cooling power to heat exchanger(s) or other loads that have the largest cooling need. In some embodiments, one or more controllable valves of valves 1526 may include a three-way valve, to avoid pressure buildup and water hammer. For example, control system 1500 may control one or more valves of valves 1526 as a safety feature including a three-way valve, a pressure relief valve, an overflow valve, or other suitable valve.

In some embodiments, control system 1500 may be configured to manage flow in or out of ports of a manifold using one or more flow controllers. For example, control system 1500 may receive sensor input from one or more sensors of sensors 1528 to determine how to distribute the available cooling power (e.g., in order to maximize the overall energy savings). In some embodiments, the distribution of flow is based on the duty cycle of the components of the cooling system, the weather, the time of day, property of the local environment, any other suitable information, or any combination thereof. For example, control system 1500 may be configured to monitor sensor inputs from sensor 1528 and properties of the heat exchanger (e.g., fluid temperatures, or heat transfer) as fault detection for cooling system 1599. To illustrate, control system 1500 may monitor a heat exchanger to gather a large amount of information about operation of cooling system 1599 and its fluid stream. For example, control system 1500 may be configured to determine temperatures of the inlets and outlets of the heat exchanger accommodating two streams and to measure the flow rate of one stream (e.g., coolant flowing through one or more cooling panels of cooling panels 1580). As a result, control system 1500 is able to accurately calculate the flow rate of the other stream (e.g., a refrigerant) based on, for example, an energy balance analysis. In some embodiments, control system 1500 is configured to detect faults in cooling system 1599 based on measured values, threshold values, comparisons of values, any other suitable criterion, or any combination thereof.

For example, if control system 1500 observes (e.g., measures, or otherwise determines based on monitoring) a change in performance, flow rate (e.g., of a coolant, refrigerant, or other fluid stream), temperature (e.g., of a fluid, surface, or solid), then control system 1500 may trigger a warning (e.g., to shut down, change operating mode, notify a user).

In an illustrative example, cooling system 1599 may be used for immersion cooling for data center servers. In a further example, cooling system 1599 may be used to cool a single-phase or two-phase fluid that is removing heat from servers. In a further example, cooling system 1599 may be used for compressor cooling. In a further example, cooling system 1599 may be configured such that cooling panels 1580 directly cool a refrigerant, rather than cool a coolant that exchanges heat with the refrigerant via a heat exchanger.

FIGS. 16-24 show illustrative cooling systems, and data acquired thereof during operation. It will be understood that the illustrative systems and plots of FIGS. 16-24 are merely illustrative, and that system configuration and performance thereof is dependent upon operating conditions, environmental conditions, load, component selection, and other factors.

Figure 16:
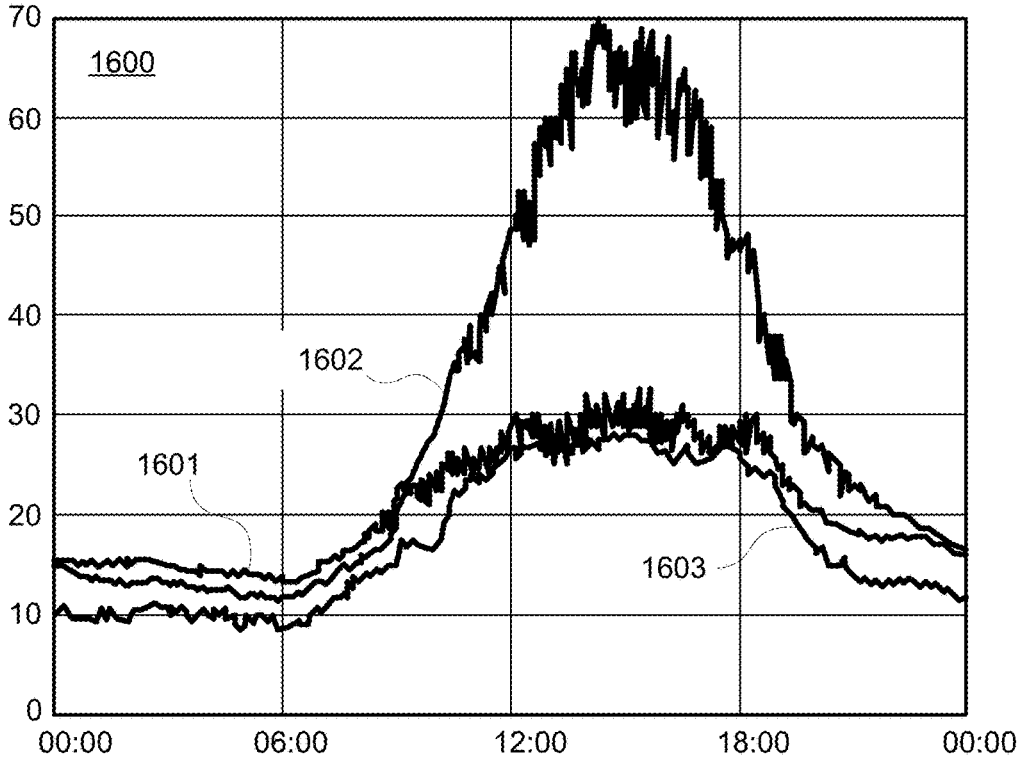
FIG. 16 shows a plot of air temperature, roof temperature, and film temperature, for an exemplary installation over 12 hours, in accordance with some embodiments of the present disclosure.

FIG. 16 shows plot 1600 of air temperature 1601, roof temperature 1602, and film temperature 1603 (e.g., of a cooling panel), for an exemplary installation over 12 hours, in accordance with some embodiments of the present disclosure. The abscissa values of plot 1600 correspond to time of day (e.g., hour:minutes), and the ordinate values of plot 1600 correspond to temperature in units of ° C. During the day (e.g., wherein temperatures are the greatest), film temperature 1603 is shown to be about 40° C. less than roof temperature 1602, and about 3° C. less than ambient air temperature 1601. Further, during the night (e.g., wherein temperatures are the lowest), the film temperature is shown to be about 6° C. less than ambient air temperature 1601. Illustrative performance results (e.g., temperatures) are illustrated in some drawings of the present disclosure. It will be understood that any illustrated performance is included as being merely exemplary.

Figure 17:
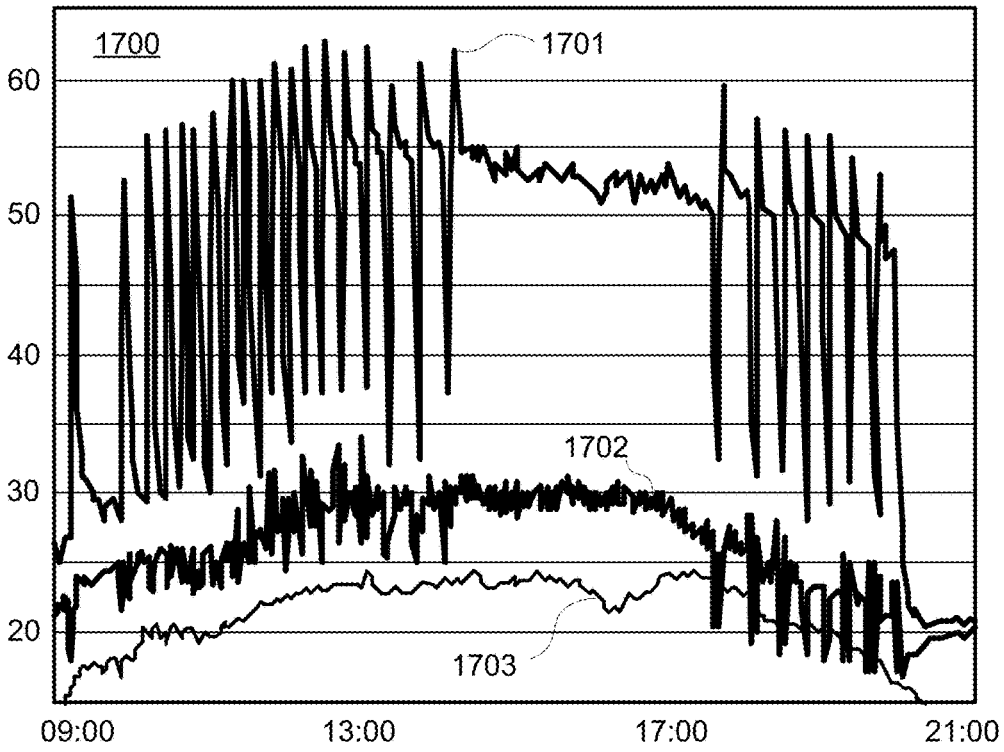
FIG. 17 shows a plot of compressor temperature, condenser outlet temperature, and film temperature, for an exemplary rooftop installation over 12 hours, in accordance with some embodiments of the present disclosure.

FIG. 17 shows plot 1700 of compressor temperature 1701, condenser outlet temperature 1702, and film temperature 1703, for an exemplary rooftop installation over 12 hours, in accordance with some embodiments of the present disclosure. The abscissa values of plot 1700 correspond to time of day (e.g., hour:minutes), and the ordinate values of plot 1700 correspond to temperature in units of ° C. During the day, film temperature 1703 is shown to be about 25° C. less than refrigerant leaving the compressor and entering the condenser (i.e., compressor temperature 1701), and about 6° C. less than the refrigerant leaving the condenser (i.e., condenser outlet temperature 1702) with condenser subcooling. For example, the cooling system, as a sub-cooler, improved efficiency by about 11%. If, for example, the cooling system was installed as a remote condenser, it may improve efficiency further (e.g., improve by about 30%). Illustrative performance results (e.g., temperatures, efficiency) are illustrated in some drawings of the present disclosure. It will be understood that any illustrated performance is included as being merely exemplary.

Figure 18:
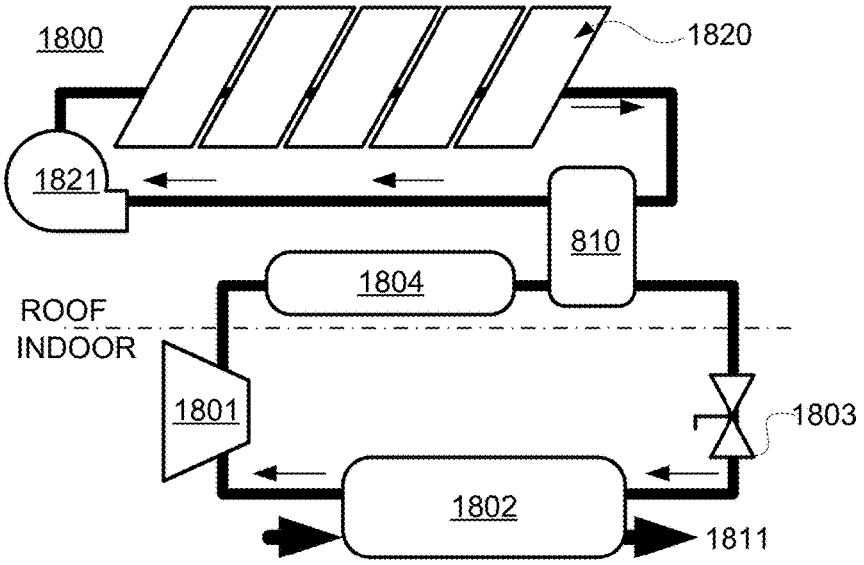
FIG. 18 shows a system diagram of an illustrative cooling system for split air conditioning units, in accordance with some embodiments of the present disclosure.

FIG. 18 shows a system diagram of illustrative cooling system 1800 for split air conditioning units (e.g., cooling load 1811), in accordance with some embodiments of the present disclosure. Cooling system 1800 is similar in configuration to cooling system 800 of FIG. 8, for example. Cooling system 1800 includes a refrigeration cycle including compressor 1801, evaporator 1802, valve 1803 (e.g., a throttle valve, or other suitable flow restriction), and condenser 1804 coupled to heat exchanger 1810, which transfers heat to a cooling cycle including cooling panels 1820 and pump 1821. Heat exchanger 1810 of cooling system 1800 illustrated in FIG. 18 may include a parallel flow heat exchanger, a cross flow heat exchanger, a co-flow heat exchanger, any other suitable type of heat exchanger, or any combination thereof.

Figure 19:
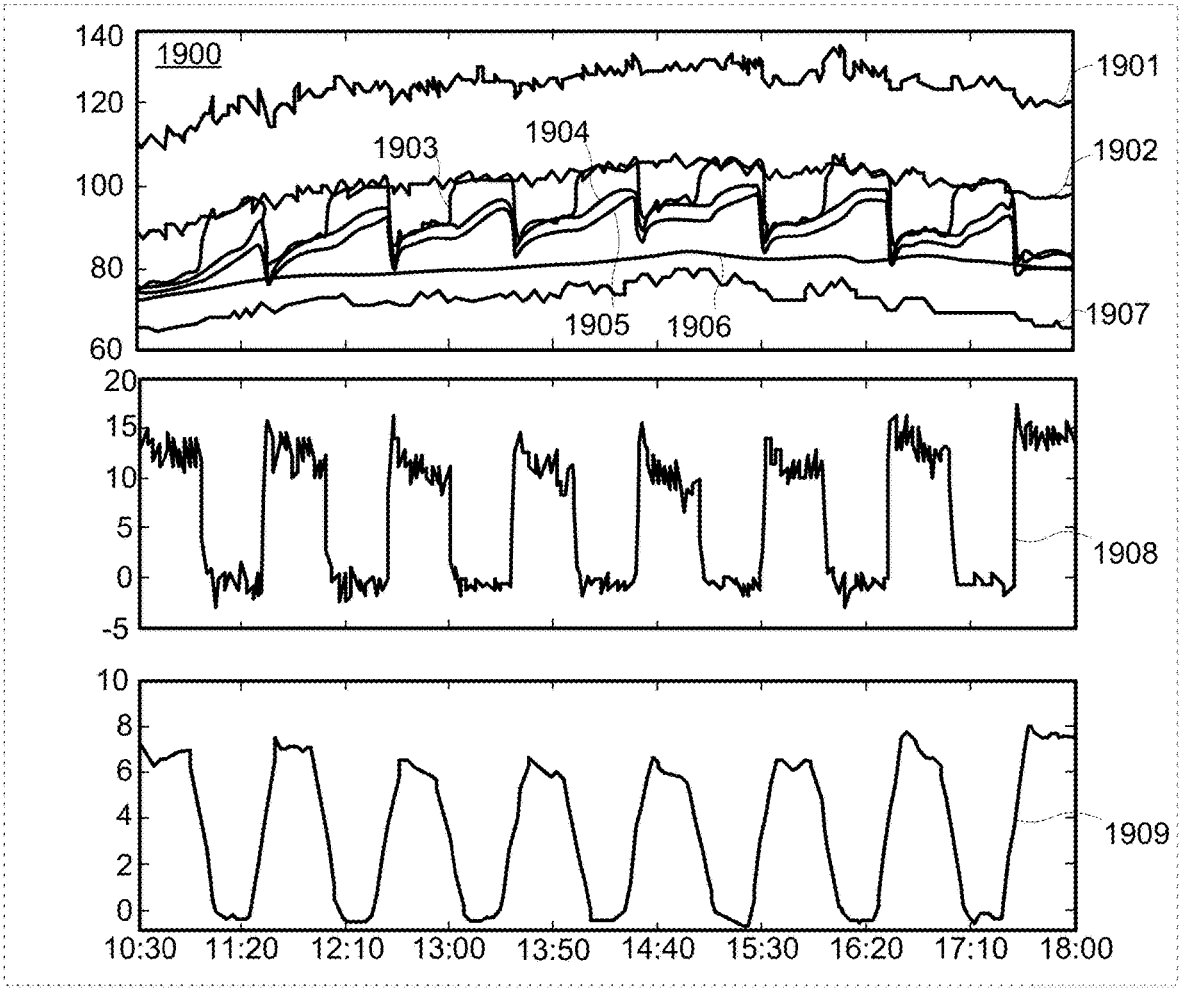
FIG. 19 shows a plot of fluid temperatures, sub-cooling, and energy savings, for the illustrative cooling system of FIG. 18, in accordance with some embodiments of the present disclosure.
Figure 22:
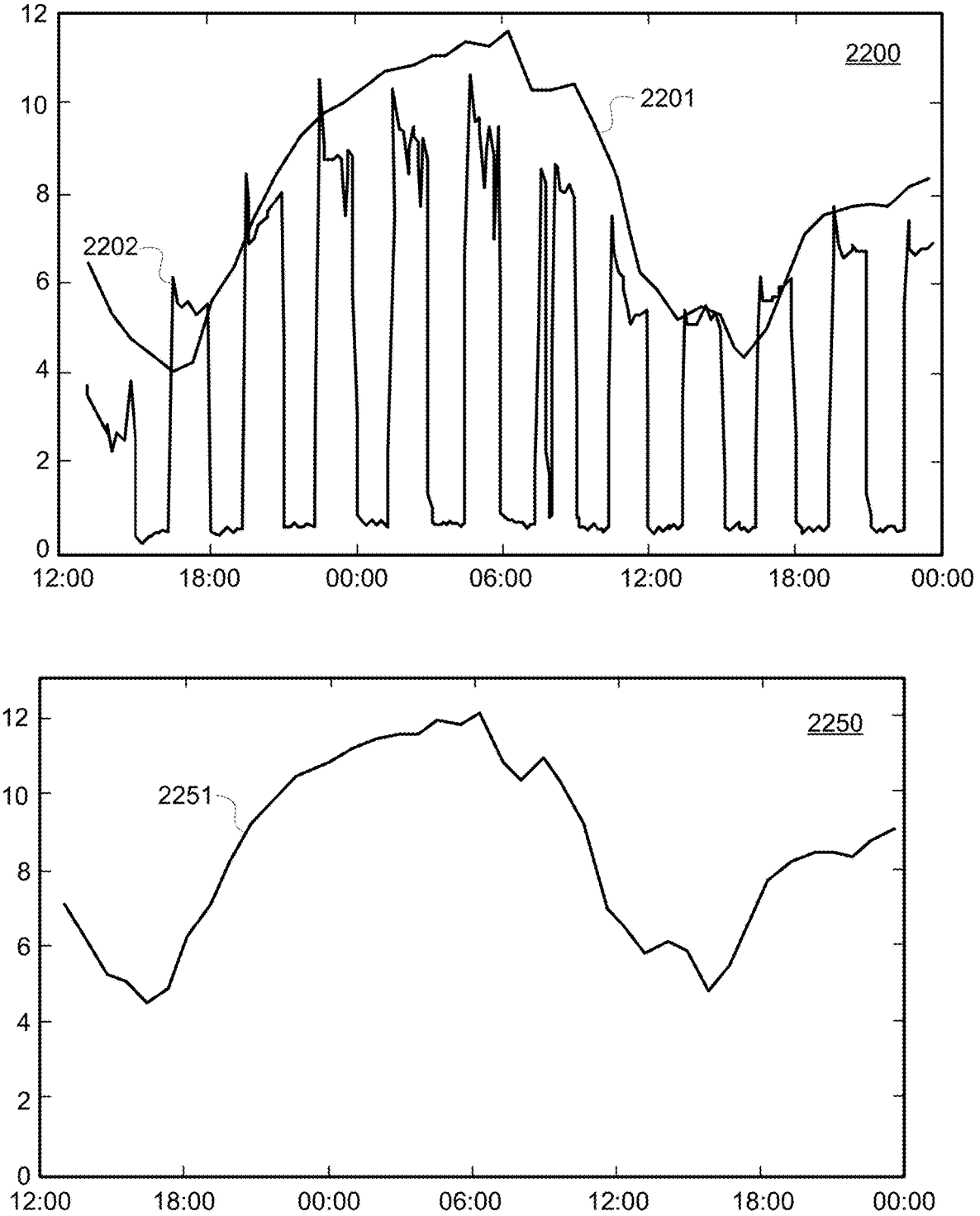
FIG. 22 shows an illustrative plot of measured and predicted sub-cooling, and an illustrative plot of energy savings, in accordance with some embodiments of the present disclosure.

FIG. 19 shows a plot of fluid temperatures 1901-1907, sub-cooling temperature differential 1908, and energy savings 1909, for cooling system 1800 of FIG. 18, in accordance with some embodiments of the present disclosure. The abscissa values of plots 1900 correspond to time of day (e.g., hour:minutes), and the ordinate values of plot 1900 correspond to (top) temperature in units of ° F., (middle) temperature difference from sub-cooling in units of ° F., and (bottom) energy savings in units of percent. The illustrative cooling system of FIGS. 18-19 is used for cooling load 1811 that includes split air conditioning units. Plot 1900 includes coolant inlet temperature 1905, coolant outlet temperature 1904, reference inlet temperature 1902, reference outlet temperature 1903, ambient air temperature 1906, condenser temperature 1901, and evaporator temperature 1907. The nominal cooling capacity of cooling system 1800 is 3.5 kW (e.g., or 1 ton), with a cooling panel fluid of 5% propylene glycol in water, with a refrigerant of R410A, and with a set point of 62° F. (e.g., with a heat load of 1.5 kW). In this illustrative example, pump 1821 that circulates the fluid through cooling panels 1820 is turned on and off every 30 minutes (e.g., exhibited by the step changes in plots of FIG. 19). Further, subcooling achieved energy savings of as high as 12%, a 9° C. improvement of subcooling for the AC unit, and a 9° C. improvement of subcooling for the freezer unit (e.g., as illustrated in FIG. 22). Cooling panels were used to cool refrigerant exiting the condenser of the AC unit, wherein about 16 $ft^2$ of cooling panels were installed per kW capacity in the freezer.

Figure 20:
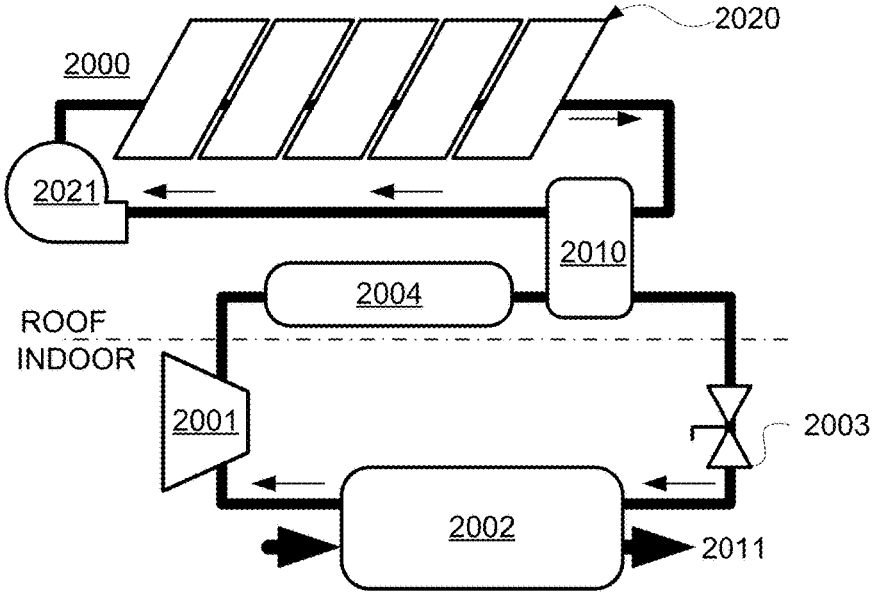
FIG. 20 shows a system diagram of an illustrative cooling system for a walk-in freezer, in accordance with some embodiments of the present disclosure.

FIG. 20 shows a system diagram of illustrative cooling system 2000 for a walk-in freezer (e.g., cooling load 2011), in accordance with some embodiments of the present disclosure. Cooling system 2000 is similar in configuration to cooling system 800 of FIG. 8 and cooling system 1800 of FIG. 18, for example. Cooling system 2000 includes a refrigeration cycle including compressor 2001, evaporator 2002, valve 2003 (e.g., a throttle valve, or other suitable flow restriction), and condenser 2004 coupled to heat exchanger 2010, which transfers heat to a cooling cycle including cooling panels 2020 and pump 2021. Heat exchanger 2010 of cooling system 2000 illustrated in FIG. 20 may include a parallel flow heat exchanger, a cross flow heat exchanger, a co-flow heat exchanger, any other suitable type of heat exchanger, or any combination thereof.

Figure 21:
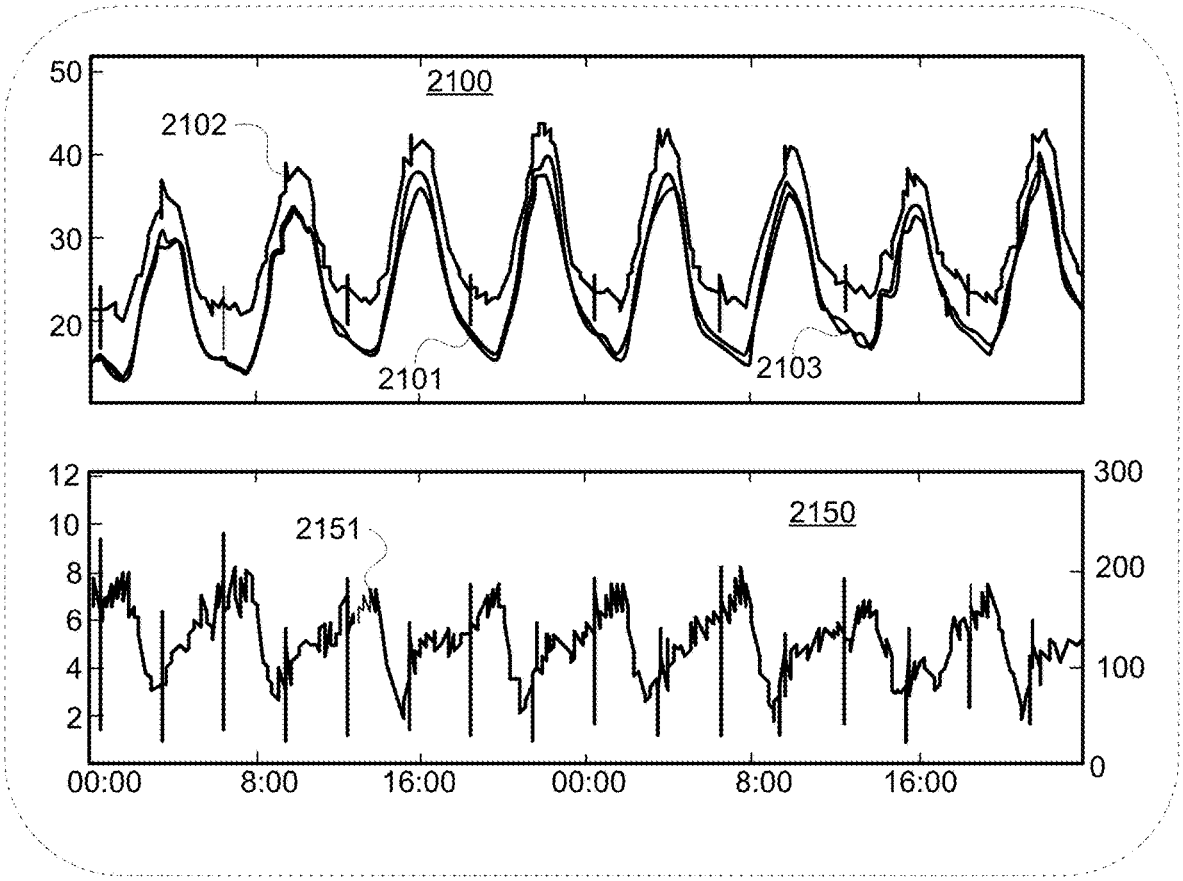
FIG. 21 shows a plot of fluid temperatures, and a plot of temperature difference, for the illustrative cooling system of FIG. 20, in accordance with some embodiments of the present disclosure.

FIG. 21 shows plot 2100 of fluid temperatures 2101-2102 and local air temperature 2103, and plot 2150 of temperature difference 2151, for the illustrative cooling system of FIG. 20, in accordance with some embodiments of the present disclosure. The abscissa values of plot 2100 correspond to time of day (e.g., hour:minutes), and the ordinate values of plot 2100 correspond to temperature in units of ° C. The abscissa values of plot 2150 correspond to time of day (e.g., hour:minutes, same as plot 2100), the left ordinate values of plot 2150 correspond to change in temperature in units of ° C. (e.g., $T_{inlet}-T_{outlet}$), and the right ordinate values of plot 2150 correspond to heat rejection from the cooling panels in units of $W/m^2$. The illustrative cooling system of FIGS. 20-21 is used for cooling load 2011 that includes a walk-in freezer. The nominal cooling capacity of cooling system 2000 is 2 kW, with a cooling panel fluid of 5% propylene glycol in water, with a refrigerant of R404A, and with an evaporator temperature of 10° F. and a heat load of 1.5 kW. Cooling panels were used to cool refrigerant exiting the condenser of the walk-in freezer, wherein about 16 $ft^2$ of cooling panels were installed per kW capacity in the freezer.

FIG. 22 shows plot 2200 of measured and predicted sub-cooling, and plot 2250 of energy savings 2251, in accordance with some embodiments of the present disclosure. The abscissa values of plot 2200 correspond to time of day (e.g., hour:minutes), and the ordinate values of plot 2250 correspond to change in temperature from additional subcooling in units of ° C. The abscissa values of plot 2250 correspond to time of day (e.g., hour:minutes, same as plot 2200), and the ordinate values of plot 2250 correspond to energy savings in units of percent. Predicted sub-cooling 2201 and actual sub-cooling 2202 are shown in units of normalized temperature differential. Plot 2200 shows a comparison between current modeling capabilities (e.g., predicted sub-cooling 2201) and measured data (e.g., actual sub-cooling 2202). Energy savings 2251 is shown in units of percent savings. Energy savings 2251 is shown for periods when the pump is running and providing additional sub-cooling.

Figure 23:
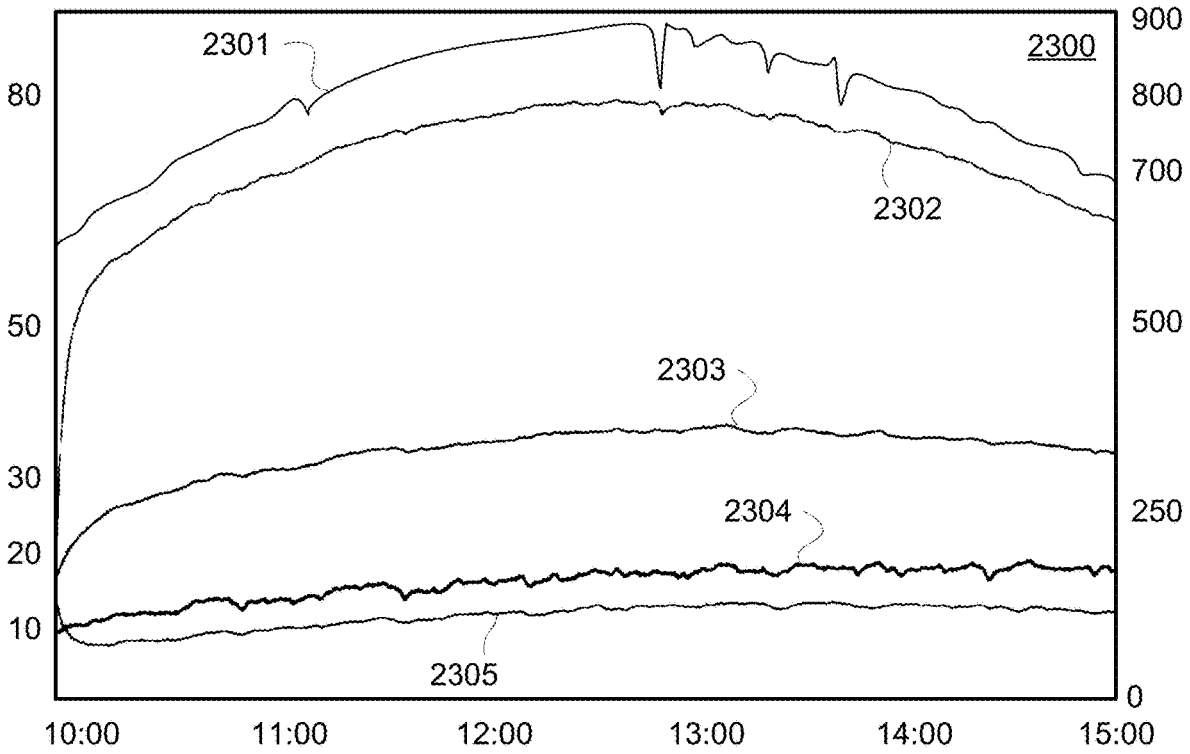
FIG. 23 shows two plots of illustrative radiative behavior of cooling panels, in accordance with some embodiments of the present disclosure.
Figure 23:
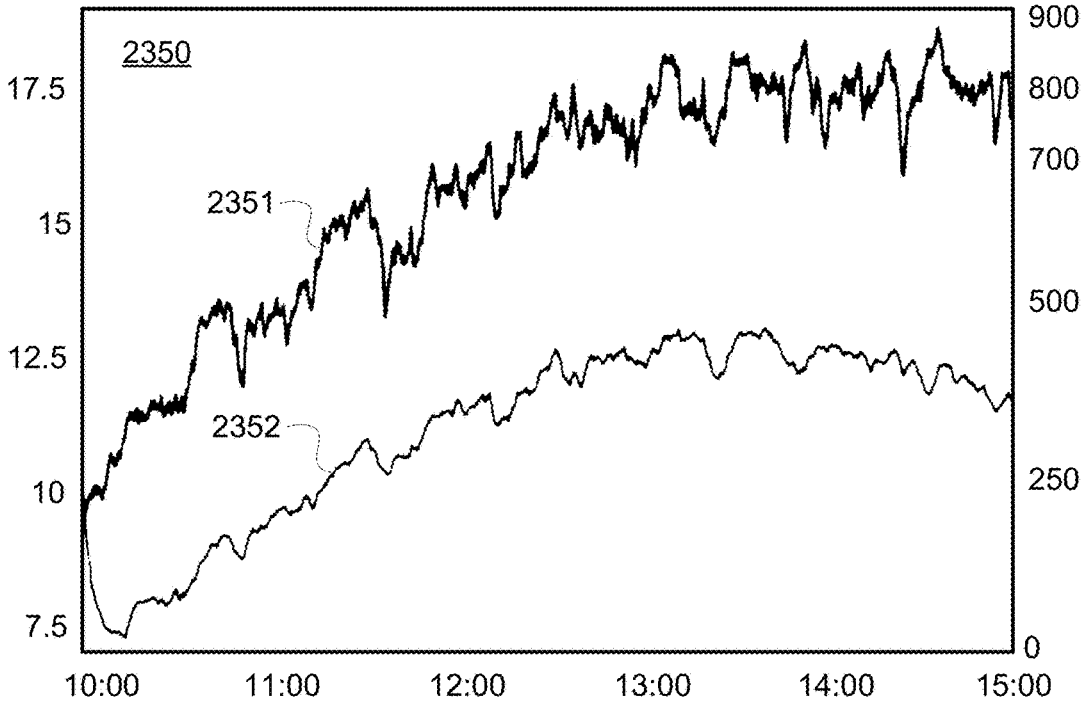

FIG. 23 shows plots 2300 and 2350 of illustrative radiative behavior of cooling panels, in accordance with some embodiments of the present disclosure. The abscissa values of plot 2300 correspond to time of day (e.g., hour:minutes), the left ordinate values of plot 2300 correspond to temperature in units of ° C., and the right ordinate values of plot 2300 correspond to solar irradiance in units of $W/m^2$. The abscissa values of plot 2350 correspond to time of day (e.g., hour:minutes, same as plot 2300), the left ordinate values of plot 2350 correspond to temperature in units of ° C., and the right ordinate values of plot 2350 correspond to solar irradiance in units of $W/m^2$. As illustrated in plot 2300, under direct sunlight with over 800 $W/m^2$ of irradiance (e.g., irradiance 2301), cooling panels achieve a temperature 2305 lower than the ambient air temperature 2304. Further, the cooling panels achieve a temperature 2305 lower than temperature 2303 of aluminum cooling plates and temperature 2302 of black paint, both under similar conditions. As illustrated in plot 2350, under direct sunlight with over 800 $W/m^2$ of irradiance, the cooling panels are shown to achieve a temperature 2352 of about 9° F. below ambient temperature 2351.

Figure 24:
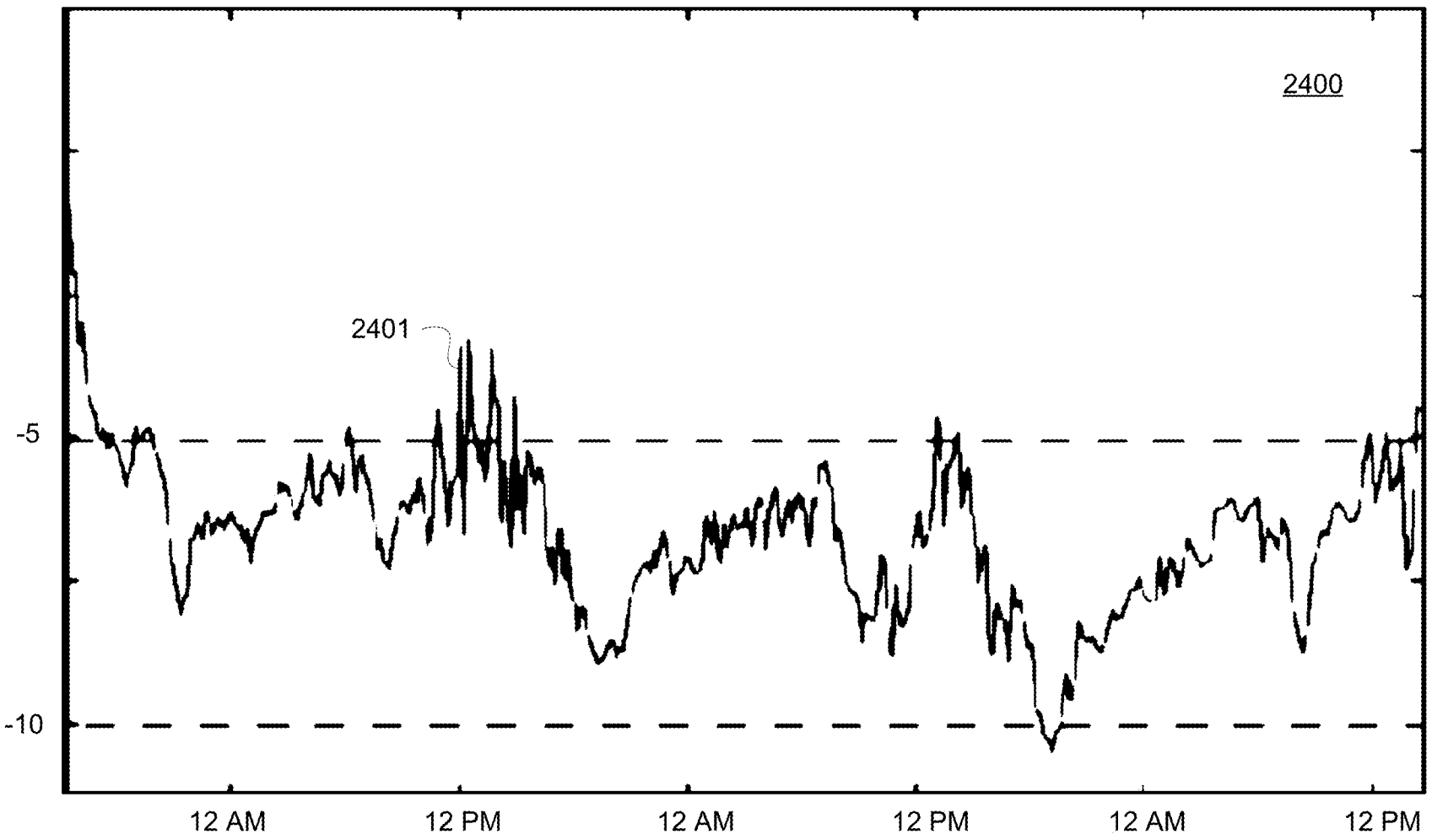
FIG. 24 shows an illustrative plot of fluid temperature compared to an ambient temperature, in accordance with some embodiments of the present disclosure.

FIG. 24 shows illustrative plot 2400 of fluid temperature compared to ambient temperature (e.g., temperature difference 2401), in accordance with some embodiments of the present disclosure. The abscissa values of plot 2400 correspond to time of day (e.g., over the course of several days), and the ordinate values of plot 2400 correspond to a difference between coolant temperature and dry-bulb temperature in units of ° F. (e.g., $T_{water}-T_{dry\text{-}bulb}$). Temperature difference 2401 was measured under conditions including a 0.75 gallon/hr/ft2 flow rate of water flowing through passages of the cooling panel, in an environment of 90° F. and 30% relative humidity. Temperature difference 2401 is the difference between the fluid temperature and the dry-bulb temperature of the environment (e.g., air). Plot 2400 demonstrates the capabilities of cooling a fluid below the ambient temperature, in accordance with the present disclosure.

Figure 25:
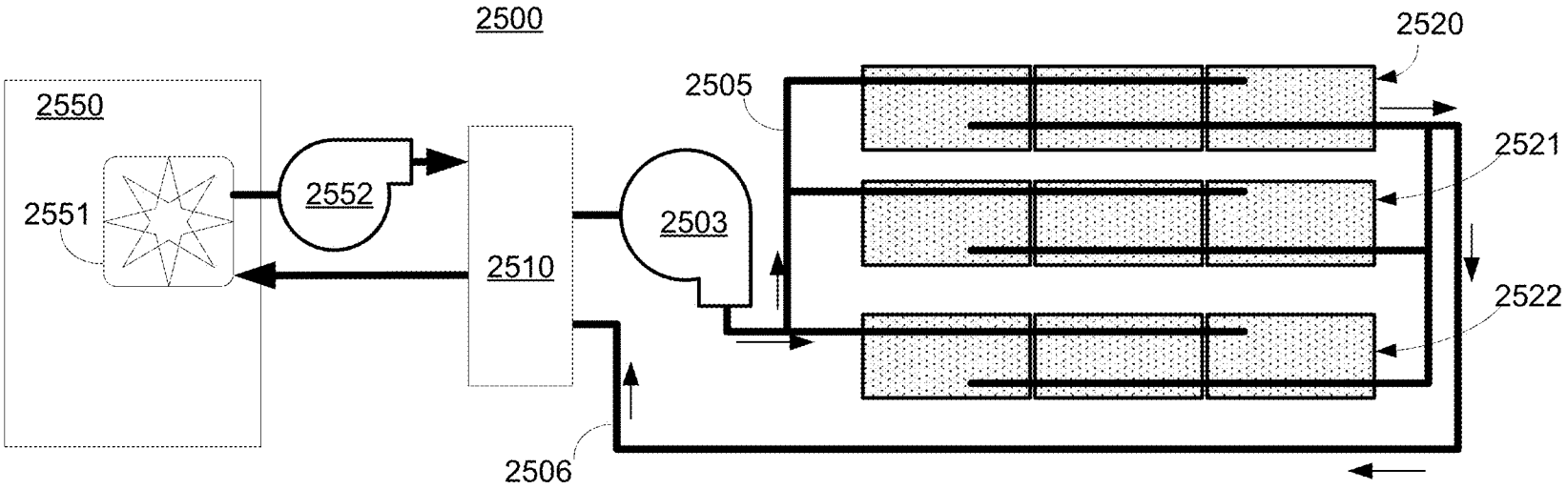
FIG. 25 shows an illustrative cooling system having thermal storage, in accordance with some embodiments of the present disclosure.

FIG. 25 shows illustrative cooling system 2500 having thermal storage 2510, in accordance with some embodiments of the present disclosure. For example, portions of cooling system 2500 may be similar to portions of cooling system 1000 of FIG. 10. Cooling system 2500 includes pump 2503 coupled to a cooling panel array (e.g., including arrays 2520, 2521, and 2522 as illustrated) by fluid conduits 2505 and 2506. Cooling system 2500 may be sized based on the size of thermal storage 2510, by sizing pump 2503, changing operation of pump 2503 (e.g., changing a motor or pump speed to change flow rate), by increasing or decreasing the number of cooling panels arrays, increasing or decreasing the number of cooling panels in each array, or a combination thereof. As illustrated, cooling system 2500 includes three cooling panel arrays (e.g., cooing panel arrays 2520, 2521, and 2522), but could optionally include one, two, or more than three cooling panel arrays, having any suitable number of cooling panels. Fluid conduits 2505 and 2506, as illustrated, are coupled to passages (e.g., to inlet or outlet ports thereof) of cooling panel arrays 2520, 2521, and 2522, which are arranged in parallel. The diameters of fluid conduits 2505 and 2506 are determined based on, for example, the total pressure loss of the system. In some embodiments, the target design condition is for the pressure loss to be less than 5 psi per 100 feet of pipe. A suitable fluid is pumped by pump 2503 through fluid conduit 2505, into passages of cooling panel arrays 2520-2522, and then into fluid conduit 2506, where the fluid is returned to thermal storage 2510. In some embodiments, pump 2503 may be arranged downstream of the cooling panels (e.g., cooling panel arrays 2520-2522, as illustrated). Fluid in thermal storage 2510 (e.g., a cold tank), which includes a suitable volume to accumulate the fluid, is pumped by pump 2552 (e.g., in any suitable pumping configuration) to cooling load 2551 of building 2550. For example, cooling load 2551 may include one or more rooms, one or more areas, one or more components, one or more systems, one or more processes, or a combination thereof. The cooling panels are used to cool thermal storage 2510, which is used to cool at least some of building 2550 or contents thereof. Although not illustrated, cooling system 2500 may include flow control valves, sensors (e.g., to sense pressure, temperature, or differences thereof), bypass flow paths, de-aerators, fill and drain ports, fluid-compatible fittings (e.g., of any suitable type), manifolds, distribution blocks, any other components not illustrated in FIG. 25, or any combination thereof. For example, pump 2503 may include one or more pumps for pumping the fluid through cooling panels.

Figure 26:
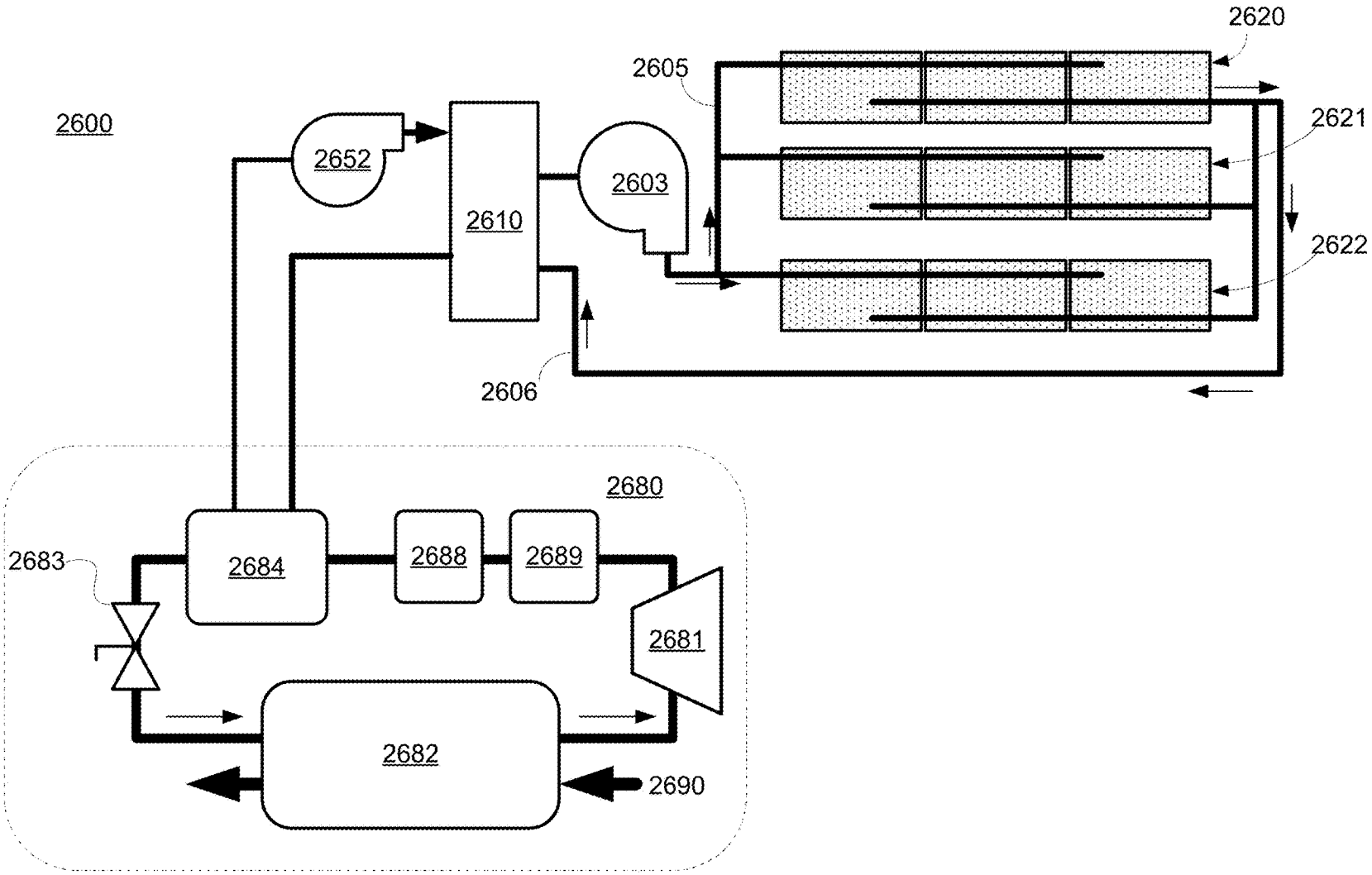
FIG. 26 shows an illustrative cooling system for sub-cooling having thermal storage, in accordance with some embodiments of the present disclosure.

FIG. 26 shows illustrative cooling system 2600 for sub-cooling having thermal storage 2610, in accordance with some embodiments of the present disclosure. For example, portions of cooling system 2600 may be similar to portions of cooling system 1000 of FIG. 10, or portions of cooling system 2500 of FIG. 25. Cooling system 2600 includes pump 2603 coupled to a cooling panel array (e.g., including arrays 2620, 2621, and 2622 as illustrated) by fluid conduits 2605 and 2606. Cooling system 2600 may be sized based on the size of thermal storage 2610, a rated capacity of pump 2603, operating parameter of pump 2603 (e.g., a motor or pump speed to change flow rate), the number of cooling panels arrays, increasing or decreasing the number of cooling panels in each array, or a combination thereof. As illustrated, cooling system 2600 includes three cooling panel arrays (e.g., cooing panel arrays 2620, 2621, and 2622), but could optionally include one, two, or more than three cooling panel arrays, having any suitable number of cooling panels. Fluid conduits 2605 and 2606, as illustrated, are coupled to passages (e.g., to inlet or outlet ports thereof) of cooling panel arrays 2620, 2621, and 2622, which are arranged in parallel. A suitable fluid is pumped by pump 2603 through fluid conduit 2605, into passages of cooling panel arrays 2620-2622, and then into fluid conduit 2606, where the fluid is returned to thermal storage 2610. In some embodiments, pump 2603 may be arranged downstream of the cooling panels (e.g., cooling panel arrays 2620-2622, as illustrated). Fluid in thermal storage 2610 (e.g., a cold tank), which includes a suitable volume to accumulate the fluid, is pumped by pump 2652 (e.g., in any suitable pumping configuration) to heat exchanger 2684. Heat exchanger 2684, as illustrated, is arranged as part of cooling cycle 2680 (e.g., coupled to cooling load 2690) that includes compressor 2681, evaporator 2682, valve 2683 (e.g., a throttle valve, or other suitable flow restriction), and condensers 2688 and 2689. Heat exchanger 2684 of cooling cycle 2680 may include a parallel flow heat exchanger, a cross flow heat exchanger, a co-flow heat exchanger, any other suitable type of heat exchanger, or any combination thereof. Compressor 2681, evaporator 2682, valve 2683, condenser 2688, and condenser 2689 may include any suitable types of respective components that may be used in, for example, a refrigeration cycle. Although not illustrated, cooling system 2600 may include flow control valves, sensors (e.g., to sense pressure, temperature, or differences thereof), bypass flow paths, de-aerators, fill ports, fluid-compatible fittings (e.g., of any suitable type), manifolds, distribution blocks, any other components not illustrated in FIG. 26, or any combination thereof. For example, pump 2603 may include one or more pumps for pumping the fluid through cooling panels.

Figure 27:
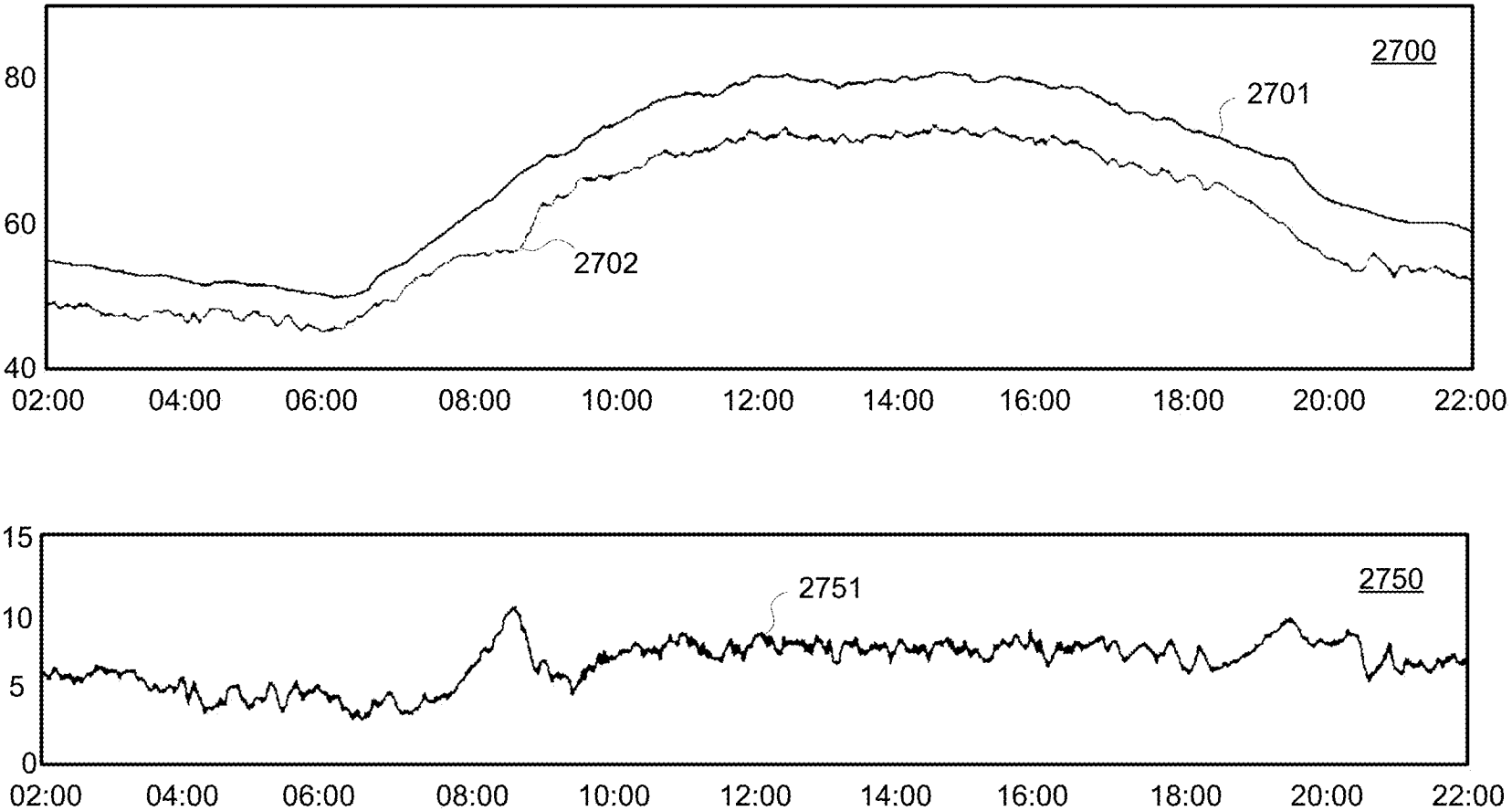
FIG. 27 shows two plots of illustrative cooling panel temperature, ambient temperature, and a comparison thereof, in accordance with some embodiments of the present disclosure.

FIG. 27 shows two plots of illustrative cooling panel temperature, ambient temperature, and a comparison thereof, in accordance with some embodiments of the present disclosure. The abscissa values of plot 2700 correspond to time of day (e.g., "hour:minute" for a 24-hour clock), and the ordinate values of plot 2700 correspond to temperature in units of ° F. The abscissa values of plot 2750 correspond to time of day (e.g., "hour:minute" for a 24-hour clock, same as plot 2700), and the ordinate values of plot 2800 correspond to temperature difference below ambient temperature in units of ° F. (e.g., positive values correspond to a panel temperature below the ambient temperature). Plot 2700 shows ambient air temperature 2701 and cooling panel temperature 2702 over the course of a day. Plot 2750 shows difference 2751 between ambient temperature 2701 and cooling panel temperature 2702 of plot 2700 over the course of the day. Ambient air temperature 2701 corresponds to a shaded air temperature (e.g., out of direct sunlight). As illustrated in FIG. 27, cooling panels may achieve sub-ambient temperatures over the course of an entire day.

Figure 28:
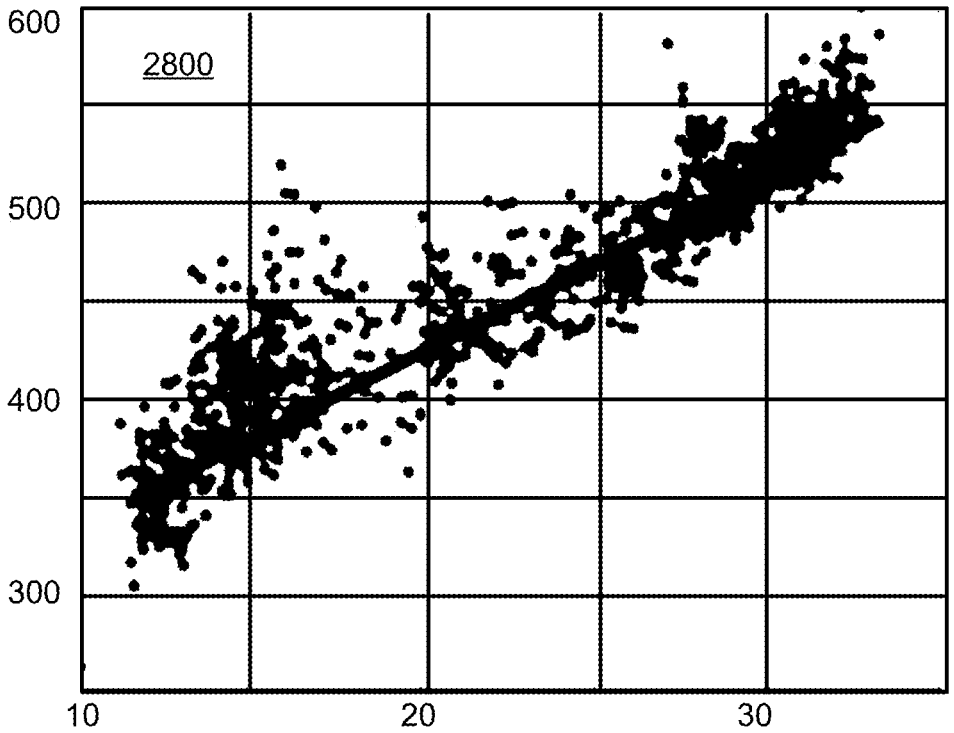
FIG. 28 shows two plots of illustrative cooling panel heat rejection and temperature (referenced to ambient), in accordance with some embodiments of the present disclosure.
Figure 28:
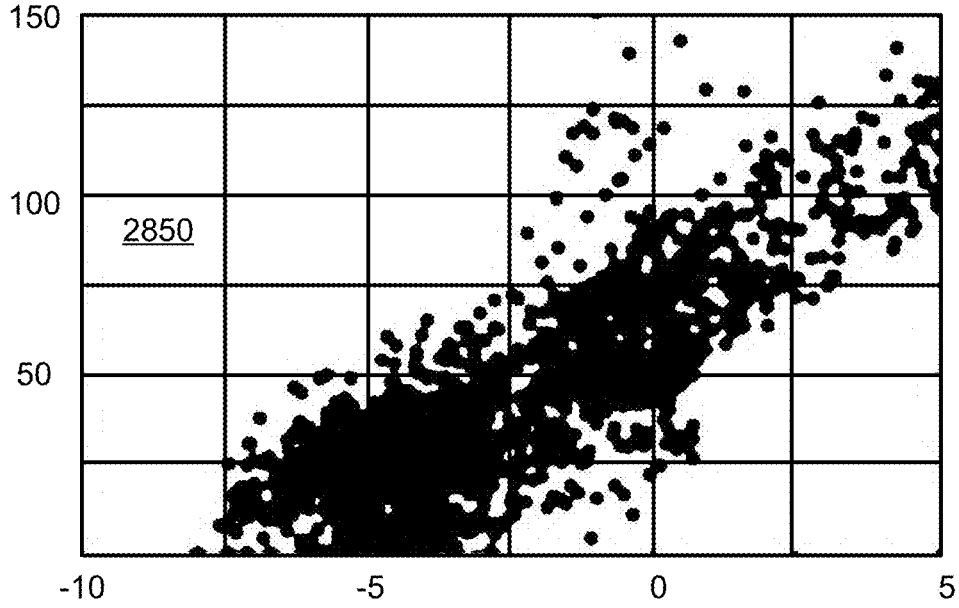

FIG. 28 shows two plots of illustrative cooling panel heat rejection and temperature (referenced to ambient), in accordance with some embodiments of the present disclosure. The abscissa values of plot 2800 correspond to a difference between the inlet fluid temperature and an ambient temperature (e.g., $T_{inlet}-T_{ambient}$) in units of ° C., and the ordinate values of plot 2800 correspond to heat rejection in units of $W/m^2$. The abscissa values of plot 2850 correspond to a difference between the inlet fluid temperature and an ambient temperature (e.g., $T_{inlet}-T_{ambient}$) in units of ° F., and the ordinate values of plot 2850 correspond to heat rejection in units of $W/m^2$. Plot 2800 shows heat rejection capability of cooling panels during a day (e.g., when the solar irradiance is greater than 100 $W/m^2$) for different inlet fluid temperatures above the ambient. Plot 2800 shows heat rejection capability of cooling panels during a day (e.g., when the solar irradiance is greater than 100 $W/m^2$), for inlet fluid temperatures nearer to the ambient temperature. For example, plot 2850 demonstrates the ability of cooling systems using cooling panels to cool a fluid below an ambient temperature.

In accordance with the present disclosure, space that may otherwise be used for solar panel installations (e.g., photovoltaic or solar-thermal installations) may be used to install cooling panels in addition or in the alternative. In an illustrative example, a cooling panel installation may achieve a power density saved in the range of 500-600 $kWhr/m^2/yr$ (e.g., cooling load), while a solar panel installation may typically achieve 250-300 $kWhr/m^2$/year of power generation. In a further illustrative example, cooling panels may achieve a simple payback period of 3-5 years, as compared to 5-8 years for typical solar photovoltaic panels. In a further illustrative example, cooling panels may achieve a twenty-four hour utilization per day while solar photovoltaic panels achieve about an eight hour utilization per day. In a further illustrative example, cooling panels weigh about 1.5 $lbs/ft^2$ while solar photovoltaic panels weigh about 2.5 $lbs/ft^2$. In some embodiments, with the reduced weight of cooling panels as compared to solar panels, only installers and specifications of a single trade are required for installation (e.g., no utility interconnect required), and cooling panels may be applicable to all roofs.

The foregoing is merely illustrative of the principles of this disclosure and various modifications may be made by those skilled in the art without departing from the scope of this disclosure. The above-described embodiments are presented for purposes of illustration and not of limitation. The present disclosure also can take many forms other than those explicitly described herein. Accordingly, it is emphasized that this disclosure is not limited to the explicitly disclosed methods, systems, and apparatuses, but is intended to include variations to and modifications thereof, which are within the spirit of the following claims.

What is claimed is:

1. A cooling system comprising:

a plurality of cooling panels for affecting a cooling load in an environment, each cooling panel comprising:

a first plate comprising a plurality of recesses and protrusions;

a second plate comprising a first side arranged against the plurality of protrusions to form a plurality of fluid channels corresponding to the plurality of recesses;

a respective film applied to a second side of the second plate opposite the first side, wherein the respective film has a set of radiative properties, a respective inlet port, and a respective outlet port, wherein a respective fluid path based on the plurality of fluid channels is arranged between the respective inlet port and the respective outlet port; and a heat exchanger comprising a first port and a second port, wherein:

the respective fluid paths collectively form a fluid path, wherein the first port and the second port of the heat exchanger are coupled to the fluid path by at least one inlet port and by at least one outlet port of the plurality of cooling panels.

2. The cooling system of claim 1, further comprising:

a control system configured to control at least one operating parameter selected from the group of operating parameters comprising a flow rate of a fluid in each respective fluid path, a temperature of the fluid entering at least one inlet port, and a temperature of the fluid exiting at least one outlet port.

3. The cooling system of claim 2, further comprising one or more valves, wherein the control system is configured to control the one or more valves to direct flow of the fluid to the heat exchanger.

4. The cooling system of claim 3, wherein the control system is configured to control each control valve of the plurality of control valves to cause the respective fluid paths of the plurality of cooling panels to be in series.

5. The cooling system of claim 3, wherein the control system is configured to control each control valve of the plurality of control valves to cause the respective fluid paths of the plurality of cooling panels to be in parallel.

6. The cooling system of claim 2, further comprising a pump for pumping the fluid through the fluid path, wherein the control system is configured to control the pump.

7. The cooling system of claim 2, wherein the control system is configured to receive one or more sensor signals from one or more sensors, and wherein the one or more sensor signals is indicative of at least one of the group comprising a flow rate of the fluid in each respective fluid path, a temperature of the fluid entering at least one inlet port, a temperature of the fluid exiting at least one outlet port, a component temperature, the second temperature, a pressure indicative of the fluid, and a difference in pressure of the fluid.

8. The cooling system of claim 1, wherein the angle of each of the plurality of cooling panels is capable of being articulated.

9. The cooling system of claim 1, further comprising:

an actuator coupled to the plurality of cooling panels, and a control system configured to actuate the actuator to change the angle of each of the plurality of cooling panels.

10. The cooling system of claim 1, wherein the cooling load is at least one of:

a refrigeration cycle;

a cooling jacket of equipment;

a thermal reservoir;

an air conditioning system; and a coolant conditioning system.

11. The cooling system of claim 1, wherein the plurality of cooling panels are arranged in an array.

12. The cooling system of claim 1, further comprising a frame to which the plurality of cooling panels are mounted, wherein the plurality of cooling panels are oriented at an angle from the sun.

13. The cooling system of claim 12, wherein the angle is between 5 and 15 degrees, inclusive.

14. The cooling system of claim 12, wherein the angle is between 7 and 12 degrees, inclusive.

15. The cooling system of claim 12, wherein the plurality of cooling panels are oriented away from Earth's equator.

16. The cooling system of claim 1, wherein each respective fluid path of the plurality of cooling panels is arranged in parallel such that each respective inlet port of the plurality of cooling panels is coupled together and each respective outlet port of the plurality of cooling panels is coupled together, and wherein each respective inlet port receives the fluid at an inlet temperature, and wherein each respective outlet port outputs the fluid at an outlet temperature less than the inlet temperature.

17. The cooling system of claim 1, wherein the plurality of cooling panels comprise a first cooling panel, a second cooling panel, and a set of cooling panels, wherein each respective fluid path of the set of cooling panels is arranged in series such that each respective inlet port of the plurality of cooling panels is coupled to one respective outlet port of another cooling panel, and wherein the first cooling panel is arranged to receive a fluid at an inlet temperature, and wherein the second cooling panel is arranged to output the fluid at an outlet temperature less than the inlet temperature.

18. The cooling system of claim 1, wherein the set of radiative properties comprises a reflectivity that reduces the amount of energy from irradiance at the film transmitted to each cooling panel.

19. The cooling system of claim 1, wherein the fluid path of each cooling panel comprises a tube affixed to the cooling panel.

20. The cooling system of claim 1, further comprising:

one or more fluid conduits coupling at least one of the outlet ports of the plurality of cooling panels to the first port of the heat exchanger; and thermal insulation arranged around the one or more fluid conduits to limit heat transfer to the one or more fluid conduits from the environment.

21. The cooling system of claim 1, further comprising:

one or more fluid conduits coupling at least one of the inlet ports of the plurality of cooling panels to the second port of the heat exchanger; and thermal insulation arranged around the one or more fluid conduits to limit heat transfer to the one or more fluid conduits from the environment.

22. The cooling system of claim 1, wherein the plurality of cooling panels are configured to sub-cool the fluid in addition to cooling by a condenser coupled to the heat exchanger.

23. The cooling system of claim 1, wherein the heat exchanger is arranged upstream of a condenser of a refrigeration cycle.

24. A cooling system comprising:

a plurality of cooling panels for affecting a cooling load in an environment, each cooling panel having a set of radiative properties, and each cooling panel comprising:

a first plate comprising a plurality of recesses and protrusions, a second plate comprising a first side arranged against the plurality of protrusions to form a plurality of fluid channels corresponding to the plurality of recesses, wherein a respective fluid path based on the plurality of fluid channels and arranged between a respective inlet port and a respective outlet port;

a plurality of control valves, each control valve of the plurality of control valves coupled to a respective fluid path of a respective cooling panel, wherein each control valve controls a flow in the respective fluid path relative to the other fluid paths; and a heat exchanger comprising a first port and a second port, wherein the respective fluid paths collectively form a fluid path, wherein:

the first port and the second port of the heat exchanger are coupled to the fluid path by at least one inlet port and by at least one outlet port of the plurality of cooling panels.

25. The cooling system of claim 24, further comprising:

a control system coupled to the plurality of control valves, and configured to control the flow through each control valve of the plurality of control valves.

26. The cooling system of claim 24, wherein the plurality of cooling panels are configured to sub-cool the fluid in addition to cooling by a condenser coupled to the heat exchanger.

27. The cooling system of claim 24, wherein the heat exchanger is arranged upstream of a condenser of a refrigeration cycle.

28. A cooling system comprising:

a plurality of cooling panels for affecting a cooling load in an environment, each cooling panel having a reflectivity and an emissivity, and each cooling panel comprising:

a first plate comprising a plurality of recesses and protrusions, a second plate comprising a first side arranged against the plurality of protrusions to form a plurality of fluid channels corresponding to the plurality of recesses, and a respective fluid path based on the plurality of fluid channels and arranged between a respective inlet port and a respective outlet port; and a heat exchanger comprising a first port and a second port, wherein the respective fluid paths collectively form a fluid path, wherein:

the first port and the second port of the heat exchanger is coupled to the fluid path by at least one inlet port and by at least one outlet port of the plurality of cooling panels, a fluid enters the first port at a first temperature, and wherein the fluid exits the second port at a second temperature less than the first temperature.

29. The cooling system of claim 28, plurality of cooling panels are configured to sub-cool the fluid in addition to cooling by a condenser coupled to the heat exchanger.

30. The cooling system of claim 28, wherein the heat exchanger is arranged upstream of a condenser of a refrigeration cycle.

31. A cooling system comprising:

a first cooling loop comprising a condenser; and a second cooling loop coupled to the first cooling loop by a heat exchanger, the second cooling loop comprising a plurality of cooling panels for affecting a cooling load in an environment, each cooling panel comprising:

a first plate comprising a plurality of recesses and protrusions, a second plate comprising a first side arranged against the plurality of protrusions to form a plurality of fluid channels corresponding to the plurality of recesses, a respective film applied to a second side of the second plate opposite the first side, wherein the respective film has a set of radiative properties, a respective inlet port, a respective outlet port, wherein a respective fluid path based on the plurality of fluid channels is arranged between the respective inlet port and the respective outlet port.

32. The cooling system of claim 31, wherein the plurality of cooling panels are configured to sub-cool the fluid in addition to cooling by a condenser coupled to the heat exchanger.

* * * * *